US011600225B2

(12) United States Patent
Ma

(10) Patent No.: US 11,600,225 B2
(45) Date of Patent: Mar. 7, 2023

(54) DISPLAY PANEL AND DRIVING METHOD

(71) Applicant: Wuhan Tianma Micro-Electronics Co., Ltd., Wuhan (CN)

(72) Inventor: Xiangwen Ma, Wuhan (CN)

(73) Assignee: Wuhan Tianma Micro-Electronics Co., Ltd., Wuhan (CN)

( * ) Notice: Subject to any disclaimer, the term of this patent is extended or adjusted under 35 U.S.C. 154(b) by 0 days.

(21) Appl. No.: 17/203,180

(22) Filed: Mar. 16, 2021

(65) Prior Publication Data

US 2021/0201786 A1 Jul. 1, 2021

(30) Foreign Application Priority Data

Nov. 20, 2020 (CN) ..... 202011310350.X

(51) Int. Cl.
*G09G 3/3233* (2016.01)
*G09G 3/3266* (2016.01)

(52) U.S. Cl.
CPC ..... *G09G 3/3233* (2013.01); *G09G 3/3266* (2013.01)

(58) Field of Classification Search
CPC ..... G09G 3/3233; G09G 3/3266; G09G 2300/0814; G09G 2300/0819; G09G 2300/0866; G09G 2310/08
See application file for complete search history.

(56) References Cited

U.S. PATENT DOCUMENTS 9,330,601 B2 5/2016 Lee et al.
2022/0005414 A1* 1/2022 Liu ..... G09G 3/3266

FOREIGN PATENT DOCUMENTS

CN 107256690 A 10/2017
CN 107256695 A 10/2017
CN 110648631 A 1/2020

* cited by examiner

*Primary Examiner* — Stacy Khoo
(74) *Attorney, Agent, or Firm* — von Briesen & Roper, s.c.

(57) ABSTRACT

A display panel and a driving method are provided. The pixel driver circuit includes a drive transistor, at least two data write modules, and a light emission control module. The at least two data write modules are configured to provide data signals for the drive transistor in a time-sharing manner, and the light emission control module is connected in series respectively with the drive transistor and the light-emitting element and is configured to control whether a drive current flows through the light-emitting element.

18 Claims, 20 Drawing Sheets

DISPLAY PANEL AND DRIVING METHOD

CROSS-REFERENCE TO RELATED APPLICATIONS

This application claims priority to a Chinese patent application No. 202011310350.X filed with CNIPA on Nov. 20, 2020, the disclosure of which is incorporated herein by reference in its entirety.

TECHNICAL FIELD

The present disclosure relates to the field of display panels and, in particular, a display panel and a driving method.

BACKGROUND

An organic light-emitting display device has advantages such as self-luminescence, a low drive voltage, high luminescence efficiency, a fast response speed, lightness and thinness, and a high contrast ratio. Such devices are considered to be the next generation of the most promising display device.

The pixels in an organic light-emitting display device include a pixel driver circuit. A drive transistor in the pixel driver circuit can generate a drive current, and a light-emitting element responds to the drive current and then emits light. However, due to the limitation of the scan pulse width of the gate driver circuit, the data write stage of the pixel driver circuit is too short, resulting in undercharging of the gate of the drive transistor of the pixel driver circuit and causing a large luminous brightness in the initial stage of light emission. Especially at low gray scales, undercharging of the drive transistor in the pixel driver circuit can cause human eyes to perceive flicker.

SUMMARY

The present disclosure provides a display panel and a driving method to solve the flicker problem caused by undercharging of the drive transistor of the pixel driver circuit.

In an embodiment, the present disclosure provides a display panel. The display panel includes multiple sub-pixels arranged in an array, and each sub-pixel includes a light-emitting element and a pixel driver circuit.

The pixel driver circuit includes: a drive transistor, at least two data write modules, and a light emission control module. The at least two data write modules are configured to provide data signals for the drive transistor in a time-sharing manner. The light emission control module is connected in series respectively with the drive transistor and the light-emitting element, and the light emission control module is configured to control whether a drive current flows through the light-emitting element.

In an embodiment, the present disclosure further provides a driving method of a display panel, and the driving method is applied to the display panel described in the preceding embodiment. A drive period of the display panel includes a data write stage and a light emission stage, and the data write stage includes at least two data write sub-stages. The driving method includes steps S10 and S20. In S10, in the at least two data write sub-stages of the data write stage, the at least two data write modules provide the data signals for the drive transistor in the time-sharing manner. In S20, in the light emission stage, the light emission control module controls the drive current to flow through the light-emitting element.

DETAILED DESCRIPTION

Figure 1:
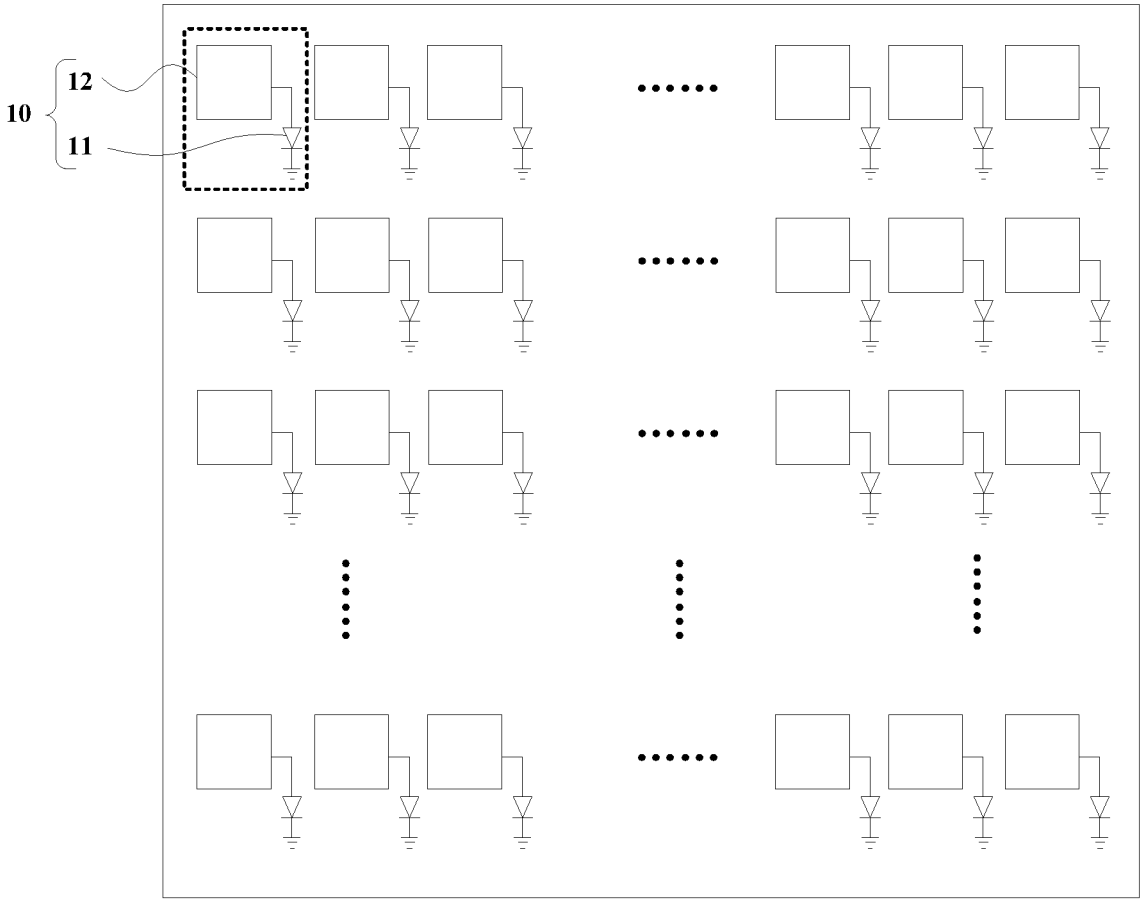
FIG. 1 is a structural diagram of a display panel, according to an embodiment of the present disclosure.

Hereinafter the present disclosure will be further described in detail in conjunction with drawings and embodiments. It is to be understood that the embodiments set forth herein are intended to explain but not limit the present disclosure. Additionally, it is to be noted that for ease of description, merely part, not all, of the structures related to the present disclosure are illustrated in the drawings.

Figure 2:
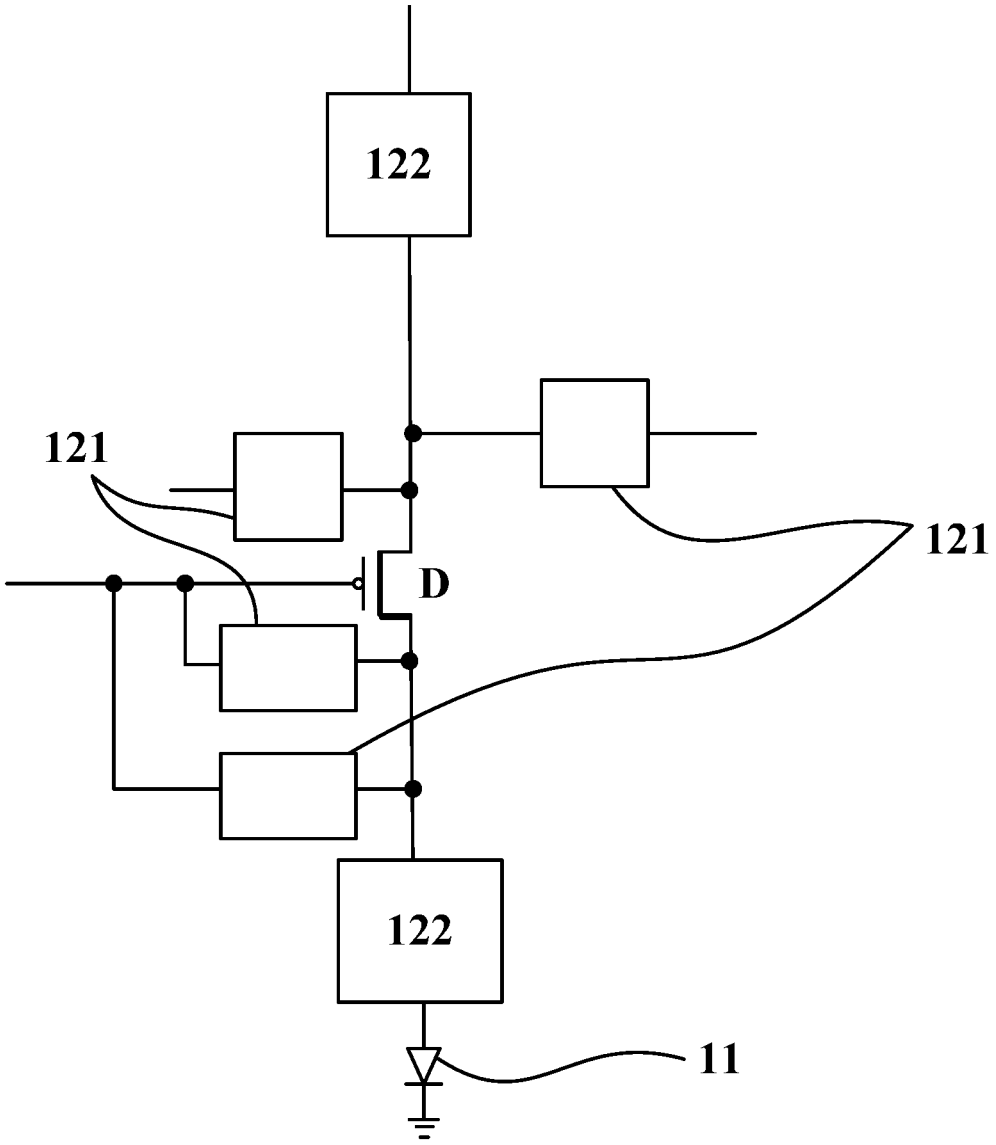
FIG. 2 is a structural diagram of a pixel driver circuit, according to an embodiment of the present disclosure.

Embodiments of the present disclosure provide a display panel. FIG. 1 is a structural diagram of a display panel according to an embodiment of the present disclosure. As shown in FIG. 1, the display panel includes multiple sub-pixels 10 arranged in an array. Each sub-pixel 10 includes a light-emitting element 11 and a pixel driver circuit 12. FIG. 2 is a structural diagram of a pixel driver circuit 12 according to an embodiment of the present disclosure. As shown in FIG. 2, the pixel driver 12 circuit includes a drive transistor D, at least two data write modules 121 (two exemplarily data write modules 121 are provided in FIG. 2), and a light emission control module 122. The at least two data write modules 121 are configured to provide data signals for the drive transistor D in a time-sharing manner. The light emission control module 122 is connected in series respectively with the drive transistor D and the light-emitting element 11, and the light emission control module 122 is configured to control whether a drive current flows through the light-emitting element 11.

Since the scan signal pulse for controlling data writing is relatively short, the charging for performing the data writing in this stage is insufficient, that is, the potential of the control terminal (gate) of the drive transistor D is smaller than the ideal potential, Vdata−|Vth|. The formula of the current for the drive transistor D to drive the light-emitting element is as follows:

$$I=K(Vsg-|Vth|)^2=K[PVDD-(V\text{data}-|Vth|)-|Vth|]^2=K(PVDD-V\text{data})^2.$$

In the above formula, $K=\frac{1}{2}\mu_p C_{OX} W/L$, where $\mu_p$ represents hole mobility, $C_{OX}$ represents a capacitance per unit area, W/L represents a width-to-length ratio, Vsg represents a voltage difference between a source and a gate of the driving transistor, PVDD represents a power voltage, Vth represents a threshold voltage of the drive transistor D, and Vdata represents a voltage of a data signal. If the potential of the gate of the drive transistor D is smaller than the ideal potential, Vdata−|Vth|, after the data is written, it can be known from the formula of the current I for the drive transistor D to drive the light-emitting element that the current I becomes larger in the initial stage of the light emission, so that human eyes can perceive that the sub-pixels 10 suddenly become bright in the initial stage of the light emission. Especially when displaying low gray scale, the voltage Vdata at the low gray scales is high compared with the voltage Vdata at high gray scales. Therefore, it takes a longer time to charge the potential of the gate of the drive transistor D to the Vdata−|Vth|, so that the issue of insufficient charging time will become more severe. Moreover, due to the low brightness of the low gray scales, the brightness difference caused by undercharging may be more appreciably perceived by the human eyes. For example, when the brightness difference caused by undercharging is 10 nits, the difference between 10 nits and 20 nits at low gray scales which is perceived by the human eye is significantly greater than the difference between 300 nits and 310 nits at high gray scales.

Therefore, in the embodiments of the present disclosure, at least two data write modules 121 are provided in the pixel driver circuit 12, and the at least two data write modules 121 provide the data signals for the drive transistor D before the light emission stage. The charging time is increased by performing the data writing multiple times, so that the data signal is sufficiently written into the drive transistor D before the light emission stage, thereby avoiding the flicker issue caused by high brightness in the initial stage of light emission due to undercharging.

Figure 3:
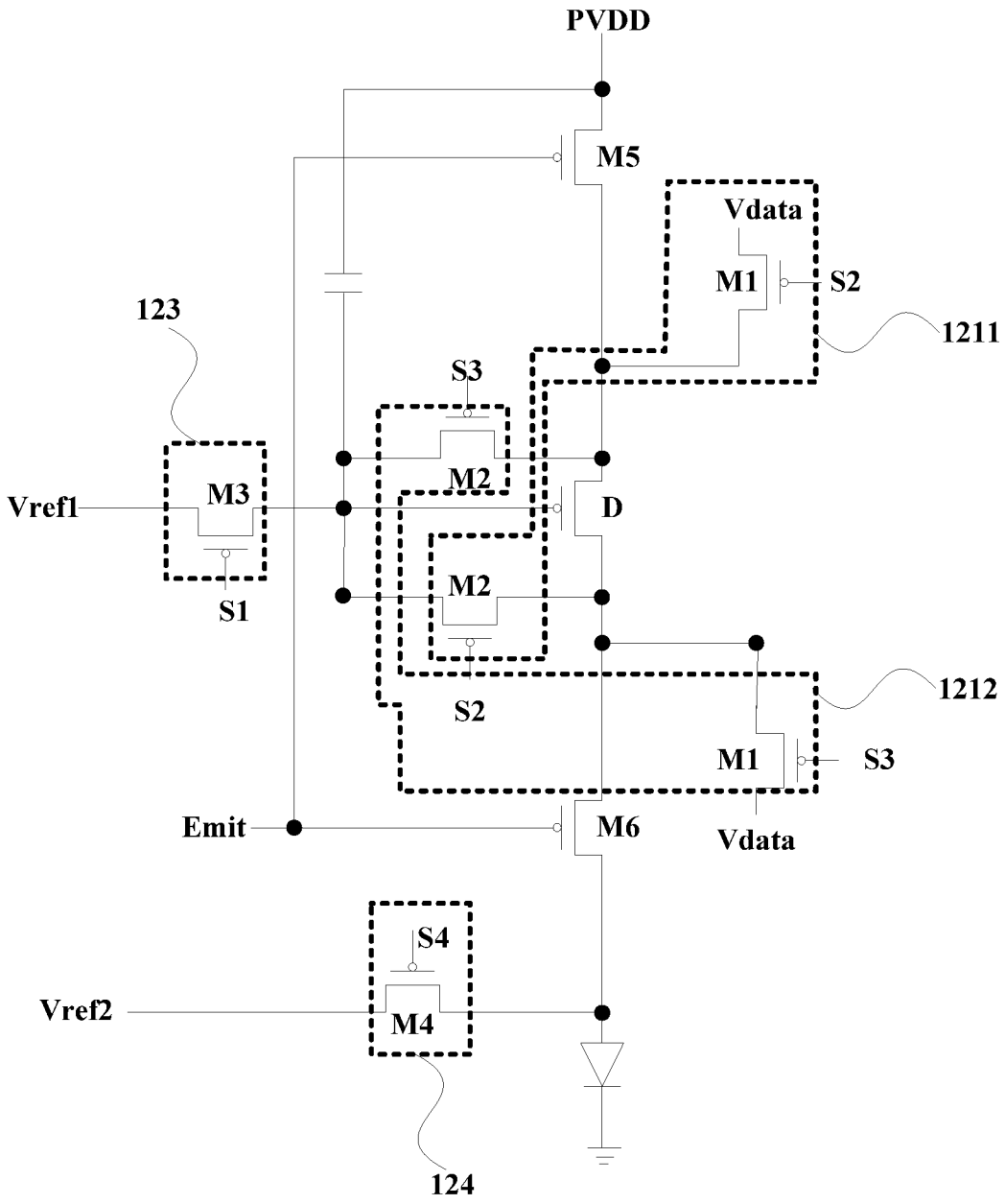
FIG. 3 is a structural diagram of another pixel driver circuit, according to an embodiment of the present disclosure.

The data write module 121 in the embodiments of the present disclosure may write the data signal through the source of the drive transistor D, that is, the data write module 121 is equivalent to a source write module. The data write module 121 may also write the data signal through a drain of the drive transistor D, that is, the data write module 121 is equivalent to a drain write module. With reference to FIG. 3, the embodiments of the present disclosure will be described by using an example in which the pixel driver circuit 12 includes two data write modules 121. For ease of description, the two data write modules 121 are denoted as a first data write module 1211 and a second data write module 1212, respectively. In the embodiment illustrated in FIG. 3, the first data write module 1211 is set to write the data signal through the source of the drive transistor D and the second data write module 1212 is set to write the data signal through the drain of the drive transistor D. Both the first data write module 1211 and the second data write module 1212 may include a first transistor M1 and a second transistor M2. The first transistor M1 is configured to write the data signal input from a data signal terminal Vdata into the drive transistor D. The second transistor M2 is configured to detect and self-compensate for a deviation of a threshold voltage of the drive transistor D.

If a data write module 121 writes the data signal through the source of the drive transistor D, for example, as the first data write module 1211 shown in FIG. 3, a first terminal of the first transistor M1 is electrically connected to the data signal terminal Vdata, and a second terminal of the first transistor M1 is electrically connected to a first terminal of the drive transistor D (the source of the drive transistor D). A first terminal of the second transistor M2 is electrically connected to the second terminal of the drive transistor D (the drain of the drive transistor D), and a second terminal of the second transistor M2 is electrically connected to the control terminal of the drive transistor D.

If a data write module 121 writes the data signal through the drain of the drive transistor D, for example, as the second data write module 1212 shown in FIG. 3, the first terminal of the first transistor M1 is electrically connected to the data signal terminal Vdata, the second terminal of the first transistor M1 is electrically connected to the second terminal of the drive transistor D (the drain of the drive transistor D), and the first terminal of the second transistor M2 is electrically connected to the first terminal of the drive transistor (the source of the drive transistor D).

The second transistor M2 of the first data write module 1211 is connected in series between the control terminal of the drive transistor D and the second terminal of the drive transistor D. The second transistor M2 of the second data write module 1212 is connected in series between the control terminal of the drive transistor D and the first terminal of the drive transistor D. Both second transistors M2 are configured to detect and self-compensate for the deviation of the threshold voltage of the drive transistor D. The pixel driver circuit 12 controls the drive current for the drive transistor D to drive the light-emitting element 11 to emit light through the voltage on the control terminal of the drive transistor D. However, due to the process, device aging and other reasons, the threshold Vth of the drive transistor D may be drifted and the mobility may be attenuated. Characteristics of the drive transistors D in each pixel driver circuit 12 may thus be inconsistent, so that non-uniformly display may occur on the display panel. The second transistor M2 alleviates or even eliminates the impact of the threshold voltage on the drive current by detecting and self-compensating for the deviation of the threshold voltage of the drive transistor D. The second transistor M2 thereby prevents the drive current flowing through the light-emitting element from being affected by non-uniformity and drift of the threshold voltage and thus effectively improves the uniformity of the drive current flowing through the light-emitting element.

Figure 4:
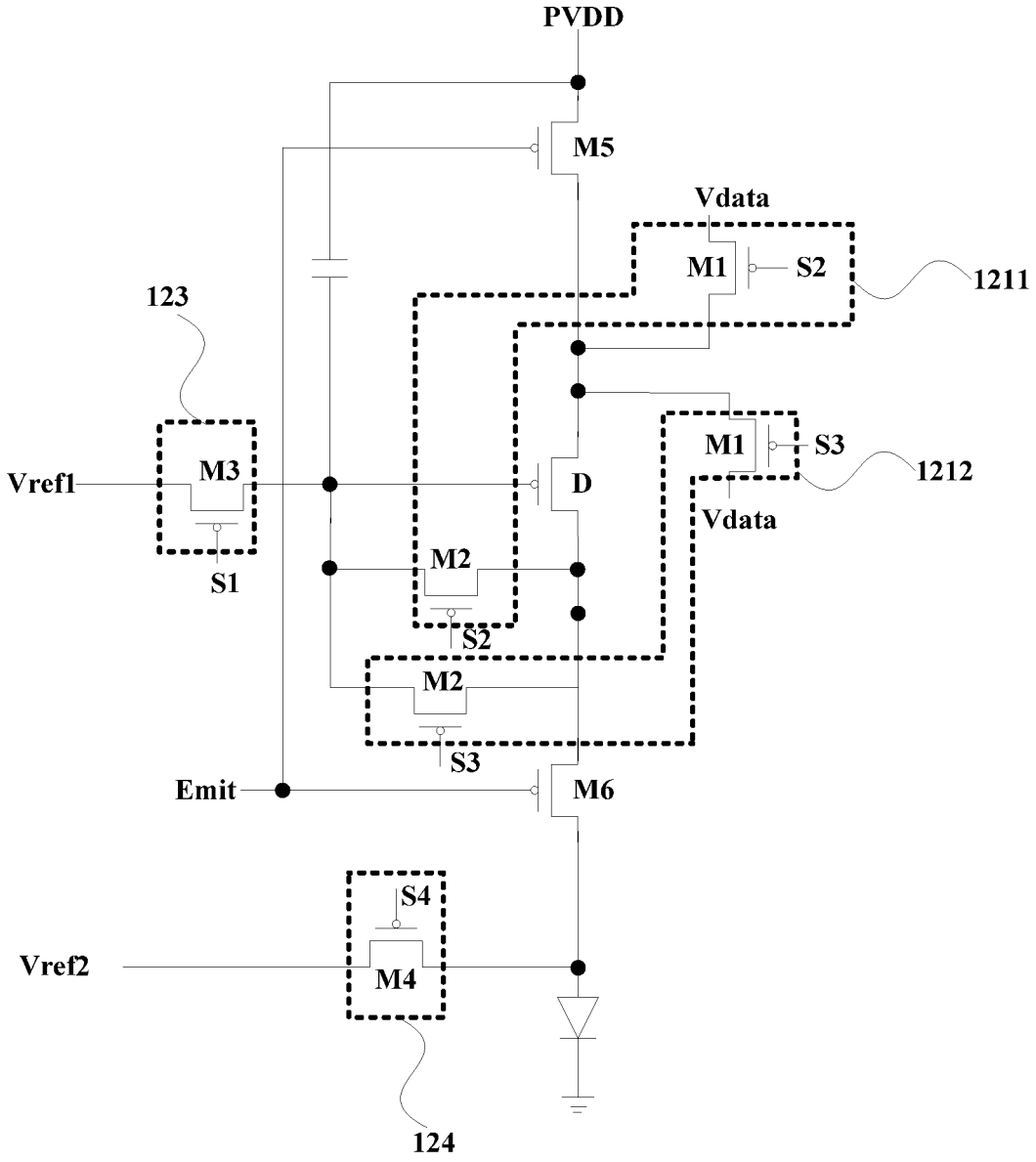
FIG. 4 is a structural diagram of another pixel driver circuit, according to an embodiment of the present disclosure.
Figure 5:
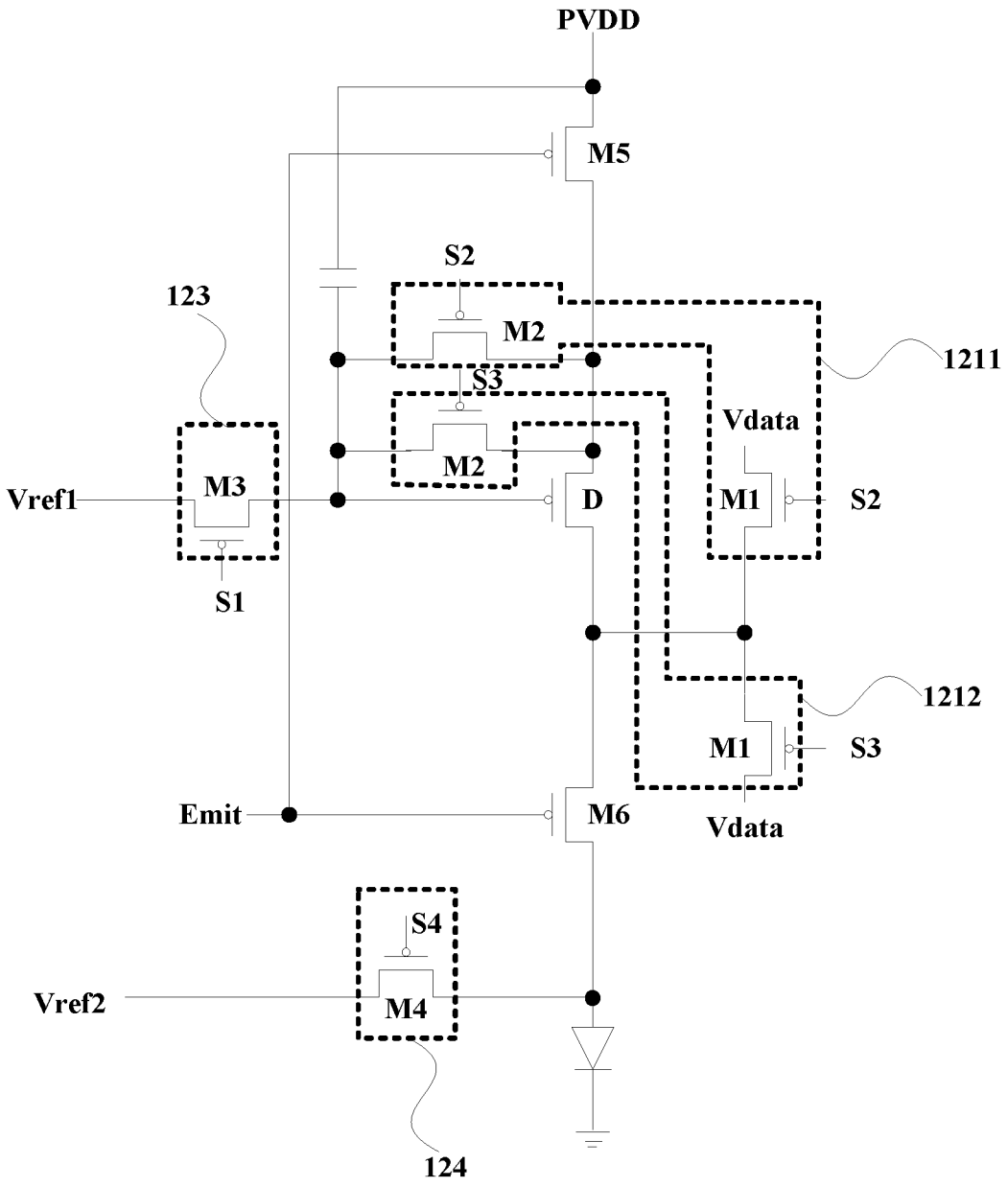
FIG. 5 is a structural diagram of another pixel driver circuit, according to an embodiment of the present disclosure.

In other implementations, each data write module 121 in the pixel driver circuit 12 may write the data signal through the source of the drive transistor D. Each data write module 121 in the pixel driver circuit 12 may also write the data signal through the drain of the drive transistor D. Alternatively, the number of data write modules 121 that write the data signals through the source of the drive transistor D and the number of data write modules 121 that write the data signals through the drain of the drive transistor D among the data write modules 121 of the pixel driver circuit 12 are set according to the actual product requirements. As shown in FIG. 4, both two data write modules 121 (the first data write module 1211 and the second data write module 1212) in the pixel driver circuit 12 write the data signal through the source of the drive transistor D. As shown in FIG. 5, both two data write modules 121 (the first data write module 1211 and the second data write module 1212) in the pixel driver circuit 12 write the data signal through the drain of the drive transistor D. Only two data write modules 121 are exemplarily provided in FIG. 3, in which one data write module 121 writes the data signal through the source of the drive transistor D and the other data write module 121 writes the data signal through the drain of the drive transistor D. The embodiments of the present disclosure do not limit the number of data write module 121*s* in the pixel driver circuit, and do not limit the number of data write modules 121 that write the data signals through the source of the drive transistor D and the number of data write modules 121 that write the data signals through the drain of the drive transistor D among the data write modules 121 in the pixel driver circuit.

On the basis of the above embodiments, the control terminal of the first transistor M1 may be electrically connected to the control terminal of the second transistor M2 in the same data write module 121. That is, the first transistor M1 and the second transistor M2 of the same data write module 121 share the same control signal, and are turned on or off simultaneously. Such configurations can reduce the number of control signal lines in the display panel. For example, with reference to FIGS. 3 to 5, the control terminal of the first transistor M1 in the first data write module 1211 is electrically connected to the control terminal of the second transistor M2 in the first data write module 1211, and the control terminal of the first transistor M1 in the second data write module 1212 is electrically connected to the control terminal of the second transistor M2 in the second data write module 1212.

Figure 6:
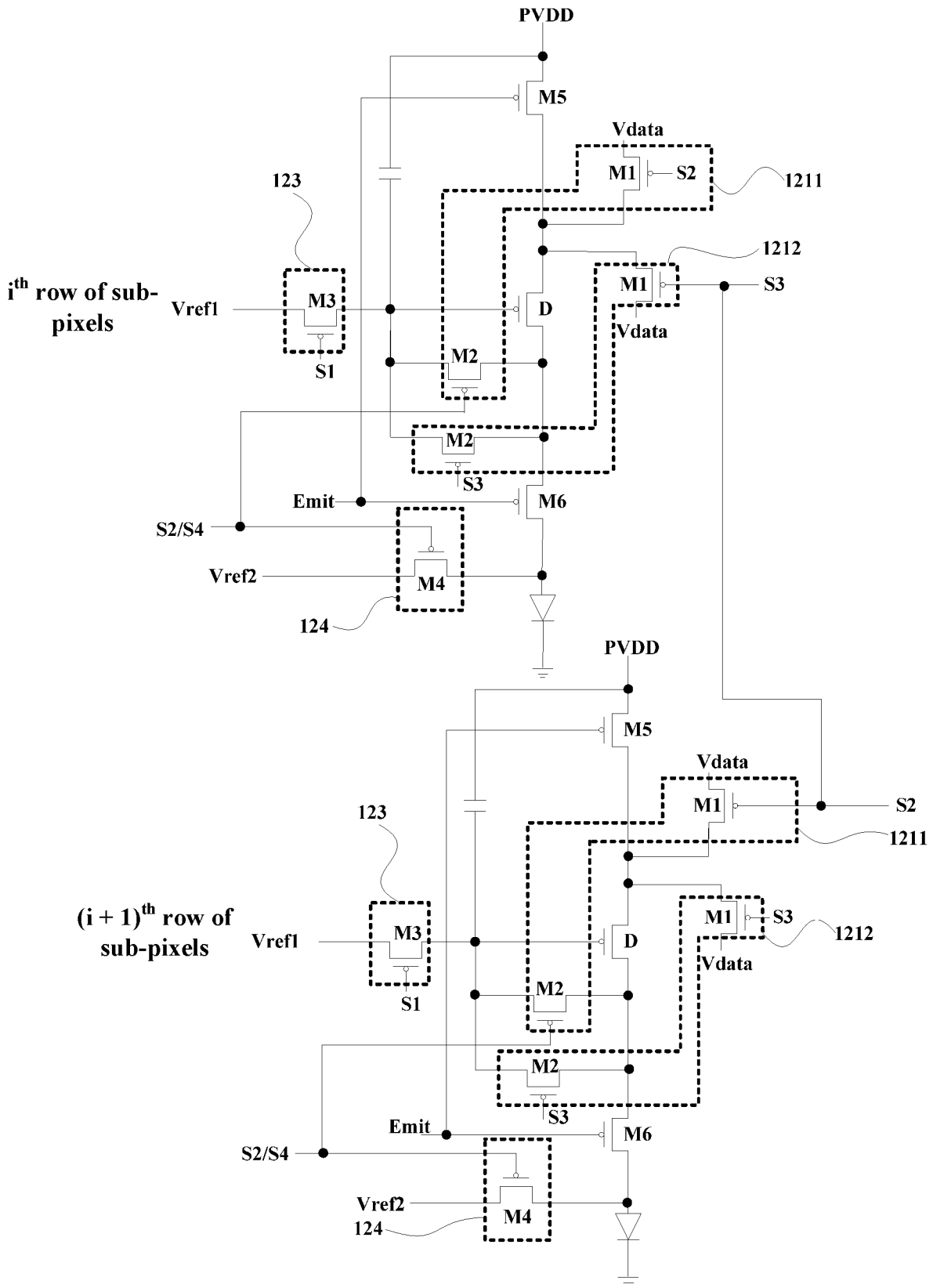
FIG. 6 is a structural diagram of another pixel driver circuit, according to an embodiment of the present disclosure.

On the basis of the above embodiments, if the pixel driver circuit 12 in the embodiments of the present disclosure includes two data write modules 121 which are denoted as the first data write module 1211 and the second data write module 1212, respectively. Both the control terminal of the first transistor M1 in the first data write module 1211 and the control terminal of the second transistor M2 in the first data write module 1211 are electrically connected to a second scan signal terminal S2. Likewise, both the control terminal of the first transistor M1 in the second data write module 1212 and the control terminal of the second transistor M2 in the second data write module 1212 are electrically connected to a third scan signal terminal S3. In order to reduce the number of signal lines in the display panel, the third scan signal terminal S3 may be set to be electrically connected to the second scan signal terminal S2 of pixel driver circuits 12 in the next row of sub-pixels 10. For example, with reference to FIG. 6, both the first data write module 1211 and the second data write module 1212 may write the data signal through the source of the drive transistor D. It is to be noted that both the first data write module 1211 and the second data write module 1212 may write the data signal through the source of the drive transistor D, or may write the data signal through the drain of the drive transistor D, or one data write module 121 may write the data signal through the source of the drive transistor D and the other data write module 121 may write the data signal through the drain of the drive transistor D.

In the embodiments of the present disclosure, both the control terminal of the first transistor M1 in the first data write module 1211 and the control terminal of the second transistor M2 in the first data write module 1211 are electrically connected to the second scan signal terminal S2, and both the control terminal of the first transistor M1 in the second data write module 1212 and the control terminal of the second transistor M2 in the second data write module 1212 are electrically connected to the third scan signal terminal S3. The third scan signal terminal S3 is electrically connected to the second scan signal terminal S2 of pixel driver circuits 12 in the next row of sub-pixel 10*s*. Since there are sub-pixel units 10 arranged in an array in the display panel, each sub-pixel unit 10 includes a pixel driver circuit 12 and a light-emitting element. In each drive period, the pixel driver circuit 12 may realize driving by scanning row by row. In order to reduce the number of signal lines in the display panel, the third scan signal terminal S3 of the pixel driver circuit 12 in an $i^{th}$ row of sub-pixels 10 may be electrically connected to the second scan signal terminal S2 of pixel driver circuits 12 in an $(i+1)^{th}$ row of sub-pixels, where i is a positive integer. In addition, when second data write modules 1212 of the pixel driver circuits 12 in the $i^{th}$ row of sub-pixels 10 perform the data writing, first data write modules 1211 of the pixel driver circuits 12 in the $(i+1)^{th}$ row of sub-pixels 10 perform the data writing at the same time, which can avoid the reduction of the refresh frequency of the display screen due to the increase of the number of data writing times.

On the basis of the above embodiments, the pixel driver circuit 12 in the embodiments of the present disclosure may further include a first reset module 123. For example, with reference to FIGS. 3 to 6, the first reset module 123 is electrically connected to the control terminal of the drive transistor D and is configured to reset the control terminal of the drive transistor D. In order to prevent the voltage on the control terminal of the drive transistor D from affecting the display of the next frame of image when the previous frame of image is displayed, in the embodiment of the present disclosure, the control terminal of the drive transistor D is reset before the data signals are provided for the drive transistor D. Before the data signals are provided for the drive transistor D, the first reset module 123 is turned on and resets the control terminal of the drive transistor D.

The first reset module 123 may include a third transistor M3. The third transistor M3 is connected in series between the control terminal of the drive transistor D and a first reset signal terminal Vref1. After the third transistor M3 is turned on, a reset signal input from the first reset signal terminal Vref1 is transmitted to the control terminal of the drive transistor D to reset the control terminal of the drive transistor D.

On the basis of the above embodiments, the pixel driver circuit 12 in the embodiments of the present disclosure may further include a second reset module 124. For example, with reference to FIGS. 3 to 6, the second reset module 124 is electrically connected to the light-emitting element 11 and is configured to reset the light-emitting element 11. Before the light emission stage, the voltage on the electrode of the light-emitting element may be reset by the second reset module 124, so as to prevent the potential on the electrode of the light-emitting element in a previous drive period from affecting the image display in the current drive period.

The second reset module 124 may include a fourth transistor M4. The fourth transistor M4 is connected in series between a second reset signal terminal Vref2 and the light-emitting element 11.

The control terminal of the fourth transistor M4 may be electrically connected to a fourth scan signal terminal S4. A fourth scan signal input from the fourth scan signal terminal S4 controls the fourth transistor M4 to be turned on, and the fourth transistor M4 transmits a reset signal input from the second reset signal terminal Vref2 to the light-emitting element 11.

In order to reduce the number of signal lines in the display panel, the fourth scan signal terminal S4 may be electrically connected to one of the control terminal of the first transistor M1 or the control terminal of the second transistor M2 in any one of the at least two data write modules 121. For example, with reference to FIGS. 6 and 7, the fourth scan signal terminal S4 is electrically connected to the control terminal of the second transistor M2 of the first data write module 1211, and when the first data write module 1211 performs the data writing, the fourth transistor M4 is controlled to be turned on to reset the electrode of the light-emitting element.

It is to be noted that in other implementations, which data write module 121 in the pixel driver circuit, in which the control terminal of the first transistor M1 or the second transistor M2 is electrically connected to the fourth scan signal terminal S4, may be selected according to actual product requirements such as requirements of the line arrangement in the display panel.

Figure 8:
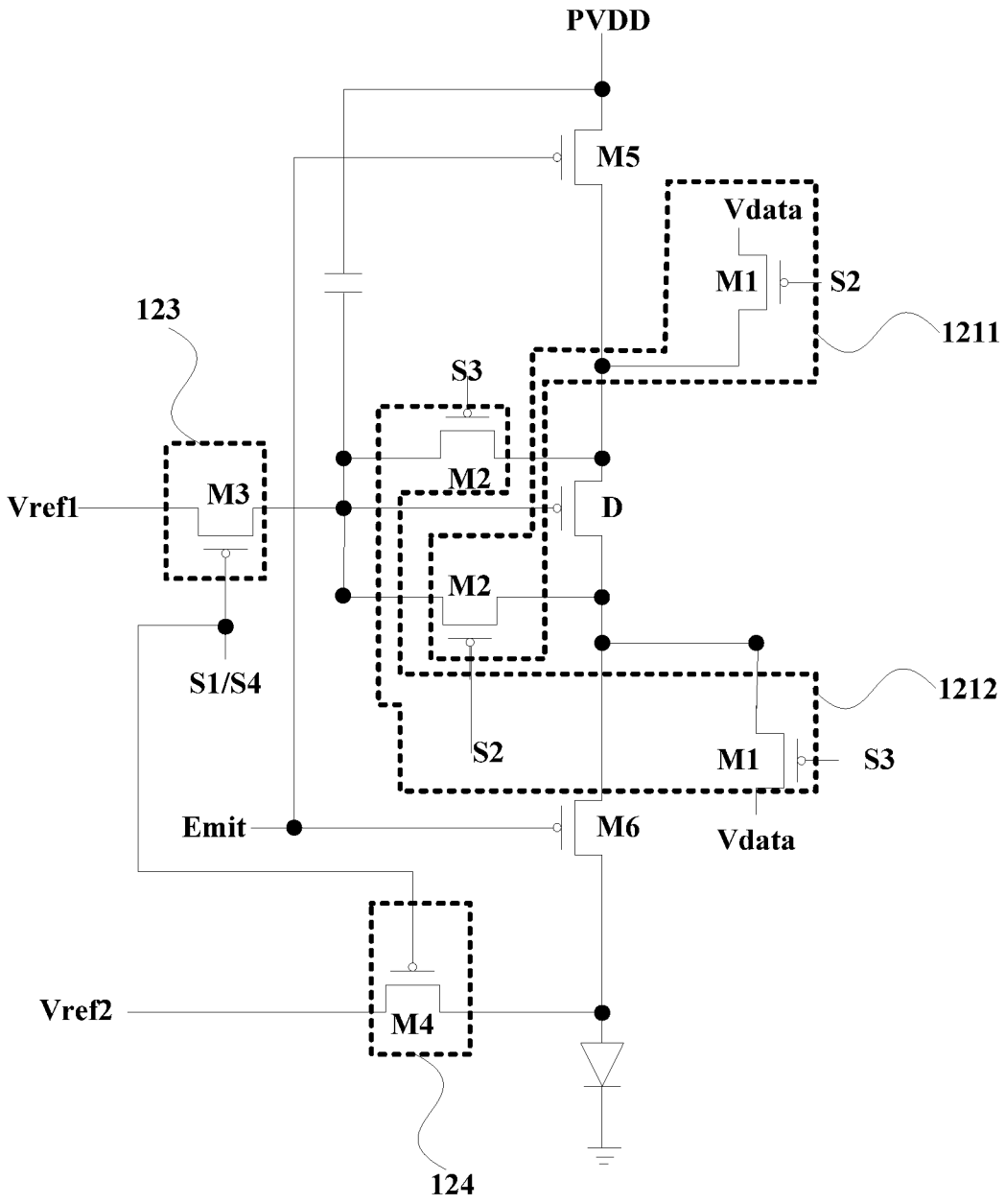
FIG. 8 is a structural diagram of another pixel driver circuit, according to an embodiment of the present disclosure.

The third transistor M3 of the first reset module 123 may be connected in series between the control terminal of the drive transistor D and the first reset signal terminal Verf1. The control terminal of the fourth transistor M4 is electrically connected to the fourth scan signal terminal S4, a control terminal of the third transistor M3 is electrically connected to the first scan signal terminal S1, and the fourth scan signal terminal S4 may also be electrically connected to the first scan signal terminal S1. For example, with reference to FIG. 8, the fourth scan signal terminal S4 may also be electrically connected to the first scan signal terminal S1, that is, the first scan signal of the first scan signal terminal S1 simultaneously controls the third transistor M3 and the fourth transistor M4 to be turned on or off, and controls the first reset module 123 and the second reset module 124 to simultaneously perform a reset operation. Such configurations can also reduce the number of signal lines in the display panel.

Figure 9:
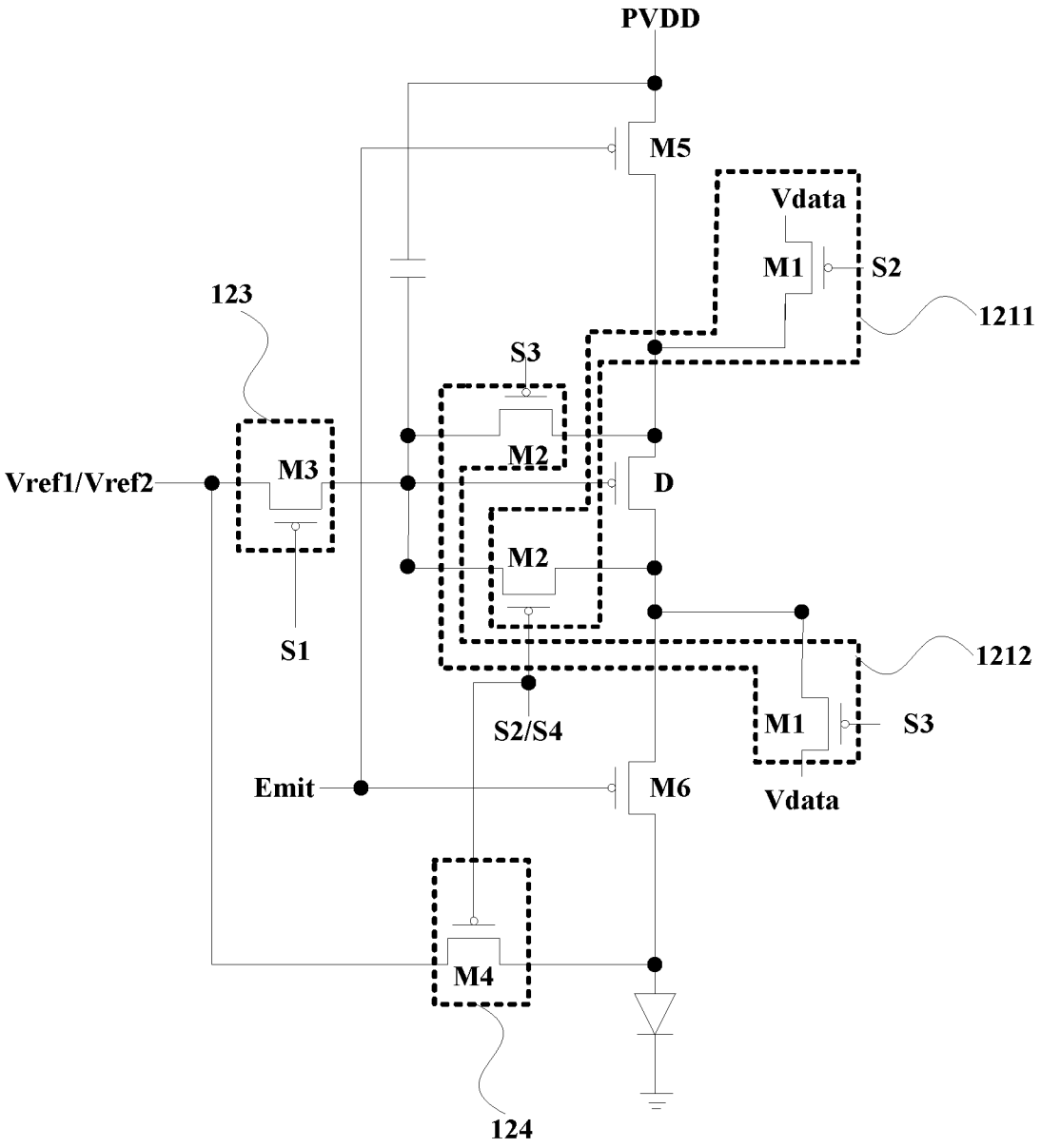
FIG. 9 is a structural diagram of another pixel driver circuit, according to an embodiment of the present disclosure.

In order to further reduce the number of signal lines in the display panel, the first reset signal terminal may also be set to be electrically connected to the second reset signal terminal. For example, with reference to FIG. 9, the first reset module 123 and the second reset module 124 may use a same reset signal line to acquire the reset signal.

On the basis of the above embodiments, the light emission control module 122 may include a fifth transistor M5 and a sixth transistor M6. A first terminal of the fifth transistor M5 is electrically connected to a first power signal terminal PVDD, and a second terminal of the fifth transistor M5 is electrically connected to the first terminal of the drive transistor D. A first terminal of the sixth transistor M6 is electrically connected to the second terminal of the drive transistor D, and a second terminal of the sixth transistor M6 is electrically connected to the light-emitting element 11. In the data write stage, and stages before the data write stage, the fifth transistor M5 and the sixth transistor M6 are turned off. In the light emission stage, the fifth transistor M5 and the sixth transistor M6 are turned on to enable the drive transistor D to drive the light-emitting element to emit light.

Figure 10:
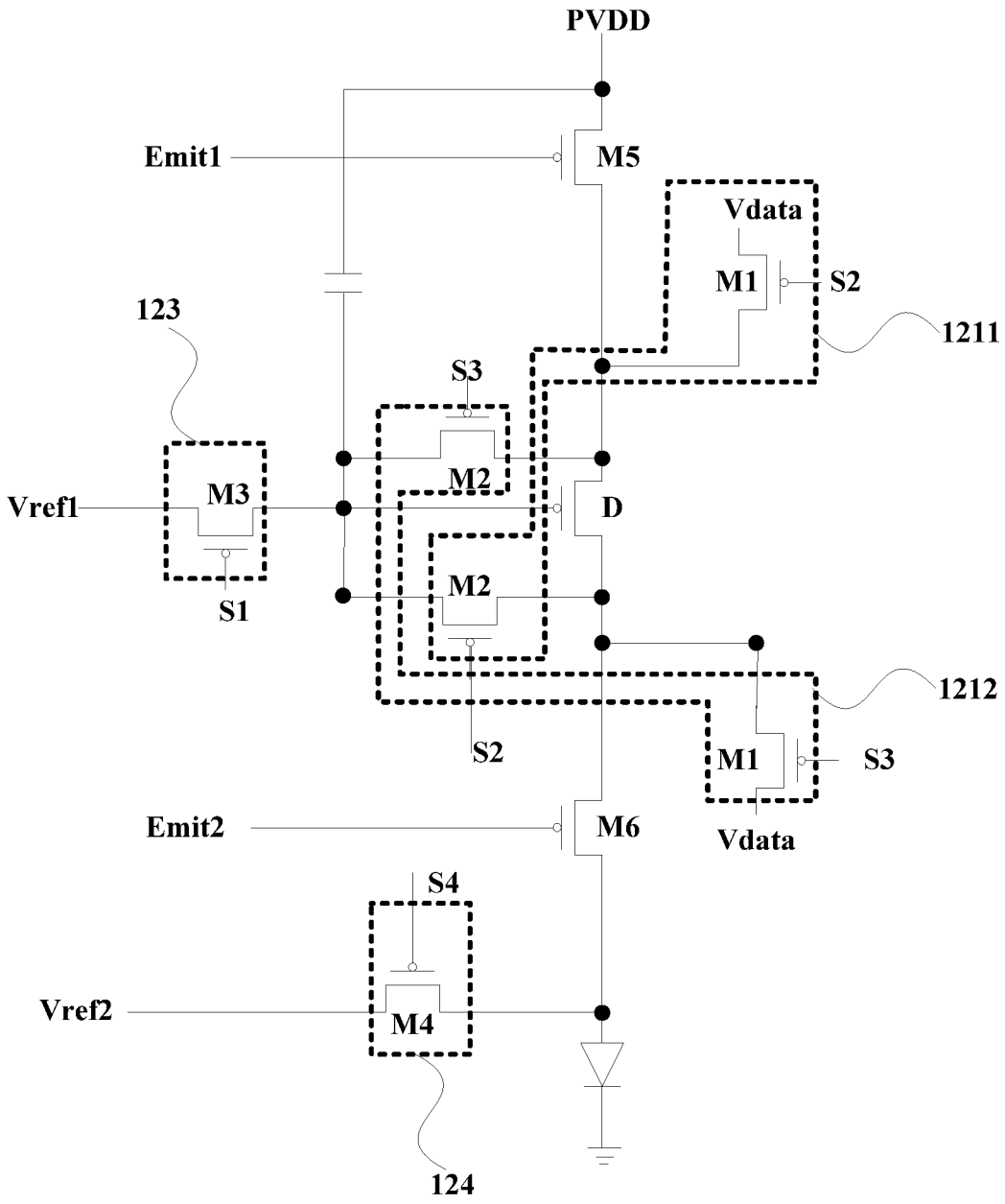
FIG. 10 is a structural diagram of another pixel driver circuit, according to an embodiment of the present disclosure.

With reference to FIG. 10, the control terminal of the fifth transistor M5 is electrically connected to a first light emission control signal input terminal Emit1, and the control terminal of the sixth transistor M6 is electrically connected to a second light emission control signal input terminal Emit2. Since the control terminal of the fifth transistor M5 and the control terminal of the sixth transistor M6 are connected to different light emission control signal input terminals, the timing input from the first light emission control signal input terminal Emit1 and the timing input from the second light emission control signal input terminal Emit2 may be the same or different. For example, when the control terminal of the drive transistor D is reset, the sixth transistor M6 is controlled to be turned on by the timing input from the second light emission control signal input terminal Emit2, so that the light-emitting element 11 is also reset.

The control terminal of the fifth transistor M5 and the control terminal of the sixth transistor M6 may be connected to a same light emission control signal input terminal Emit, as shown in FIGS. 3 to 9. That is, the fifth transistor M5 and the sixth transistor M6 are controlled to be turned on or off through a same light emission control signal. Such configurations can reduce the number of wires in the panel.

On the basis of the above embodiments, the pixel driver circuit 12 of the display panel provided by the embodiments of the present disclosure may further include a third reset module 125. The third reset module 125 is electrically connected to the first terminal of the drive transistor D and is configured to reset the first terminal of the drive transistor D.

Figure 11:
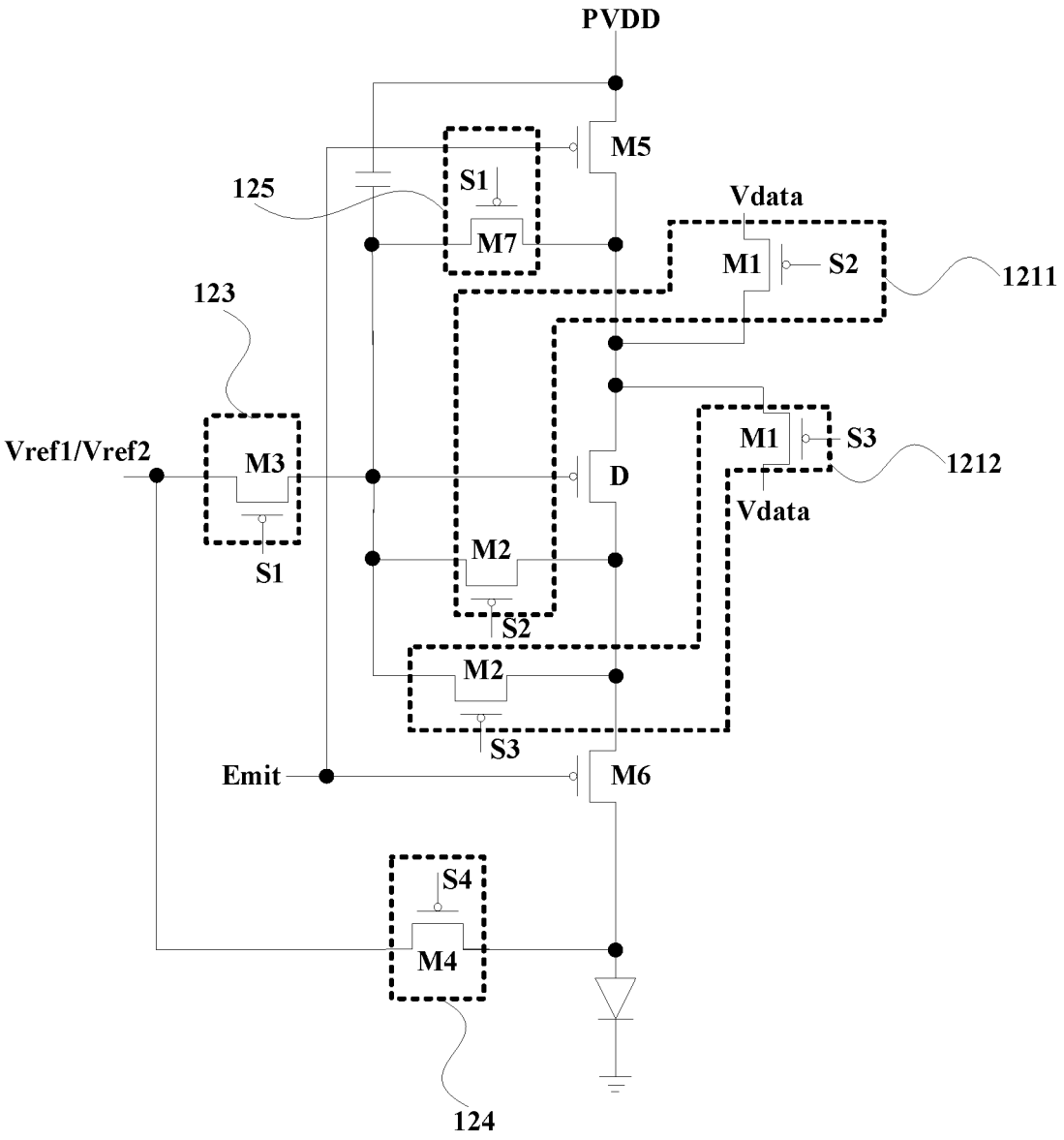
FIG. 11 is a structural diagram of another pixel driver circuit, according to an embodiment of the present disclosure.

For example, with reference to FIG. 11, the third reset module 125 is turned on before the data is written and resets the first terminal of the drive transistor D, so that in the data write stage, the potential difference between the control terminal and the first terminal of the drive transistor D is zero. Therefore, regardless of the value of the gray scale of a previous frame of image, when switching to the next frame, the potential difference between the control terminal and the first terminal of the drive transistor D is the same value before the data is written, so that the residual image caused by the previous frame of image can be avoided.

For example, with reference to FIG. 11, the third reset module 125 may include a seventh transistor M7. A first terminal of the seventh transistor M7 is electrically connected to the control terminal of the drive transistor D, and a second terminal of the seventh transistor M7 is electrically connected to the first terminal of the drive transistor D. After the seventh transistor M7 is turned on, the potential of the control terminal of the drive transistor D is the same as the potential of the first terminal of the drive transistor D.

In the embodiments of the present disclosure, a control terminal of the seventh transistor M7 may also be set to be electrically connected to the control terminal of the third transistor M3. For example, as shown in FIG. 11, the first scan signal input from the first scan signal terminal S1 simultaneously controls the seventh transistor M7 and the third transistor M3 to be turned on or off. The first reset module 123 rests the first terminal of the drive transistor D while resetting the control terminal of the drive transistor D. Such configurations do not need to set control signal lines respectively for the seventh transistor M7 and the third transistor M3, and thus the number of signal lines in the display panel can be reduced.

The pixel driver circuit 12 of the display panel provided by the embodiments of the present disclosure may further include a gating module 126. The gating module 126 includes a third reset signal terminal, a data signal terminal, a first control terminal, a second control terminal, and an output terminal. The output terminal of the gating module 126 is electrically connected to one data write module 121. The gating module 126 is configured to transmit, under the control of a first control signal input from the first control terminal and a second control signal input from the second control terminal, one of a third reset signal input from the third reset signal terminal or a data signal input from the data signal terminal to the one data write module 121 electrically connected to the gating module 126.

Figure 12:
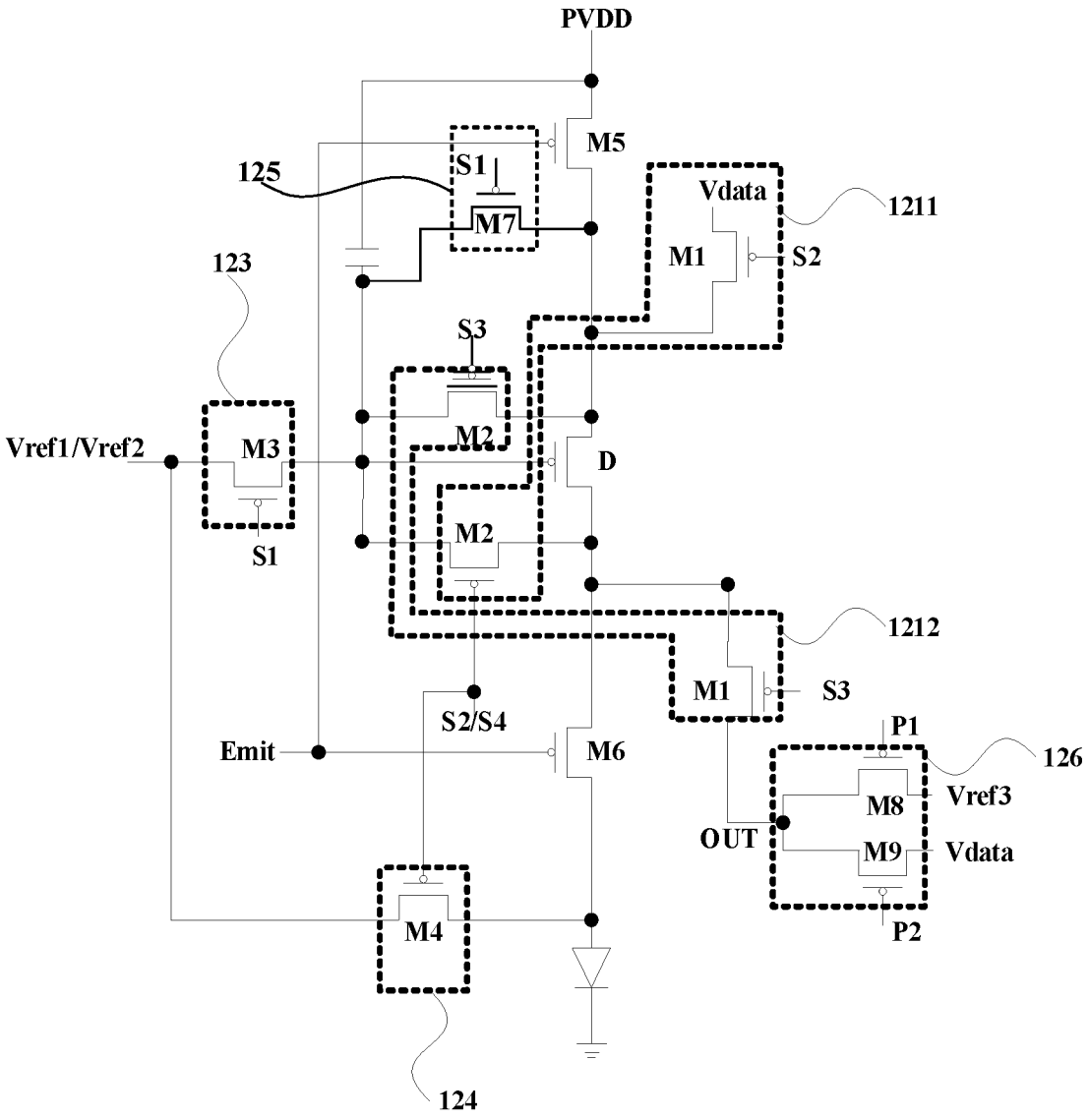
FIG. 12 is a structural diagram of another pixel driver circuit, according to an embodiment of the present disclosure.

For example, with reference to FIG. 12, the gating module 126 includes a third reset signal terminal Vref3, a data signal terminal Vdata, a first control terminal P1, a second control terminal P2, and an output terminal OUT. The output terminal OUT of the gating module 126 is electrically connected to one data write module 121. Exemplarily, as shown in FIG. 12, the output terminal OUT of the gating module 126 is set to be electrically connected to the second data write module 1212. The gating module 126 is configured to transmit, under the control of the first control signal input from the first control terminal P1 and the second control signal input from the second control terminal P2, one of the reset signal input from the third reset signal terminal Vref3 or the data signal input from the data signal terminal Vdata to the second data write module 1212. For example, when the first control signal is an effective pulse and the second control signal is an ineffective pulse, the reset signal input from the third reset signal terminal Vref3 is transmitted to the second data write module 1212, and the second data write module 1212 transmits the reset signal input from the third reset signal terminal Vref3 to the second terminal of the drive transistor D. When the first control signal is an ineffective pulse and the second control signal is an effective pulse, the data signal input from the data signal terminal Vdata is transmitted to the second data write module 1212, and the second data write module 1212 transmits the data signal input from the data signal terminal Vdata to the second terminal of the drive transistor D, thereby implementing the reset of the second terminal of the drive transistor D and the data writing in the time-sharing manner.

It is to be noted that in the embodiment illustrated in FIG. 12, the output terminal of the gating module is set to be electrically connected to the second data write module 1212, and the second data write module 1212 writes data through the drain of the drive transistor D. In other implementations, the gating module 126 may be electrically connected to any one of the at least two data write modules 121 in the pixel driver circuit, and this data write module 121 may write data through the drain of the drive transistor D or through the source of the drive transistor D. In addition, in other implementations, both the third reset module 125 and the gating module 126 may be provided in the pixel driver circuit. The third reset module 125 resets the first terminal of the drive transistor D, and the gating module 126 implements the reset of the second terminal of the drive transistor D and the data writing in a time-sharing manner.

For example, with reference to FIG. 12, the gating module 126 may include an eighth transistor M8 and a ninth transistor M9. A first terminal of the eighth transistor M8 is electrically connected to the third reset signal terminal Vref3. A second terminal of the eighth transistor M8 is electrically connected to the output terminal OUT of the gating module 126. A control terminal of the eighth transistor M8 is electrically connected to the first control terminal P1. A first terminal of the ninth transistor M9 is electrically connected to the data signal terminal Vdata. A second terminal of the ninth transistor M9 is electrically connected to the output terminal OUT of the gating module 126. A control terminal of the ninth transistor M9 is electrically connected to the second control terminal P2. When the first control terminal P1 inputs an effective pulse and the second control terminal P2 inputs an ineffective pulse, the eighth transistor M8 is turned on, and the ninth transistor M9 is turned off. The eighth transistor M8 transmits the reset signal input from the third reset signal terminal Vref3 to the first transistor M1 in the second data write module 1212. When the first transistor M1 is turned on, the reset signal input from the third reset signal terminal Vref3 is transmitted to the second terminal of the drive transistor D. When the first control terminal P1 inputs an ineffective pulse and the second control terminal P2 inputs an effective pulse, the eighth transistor M8 is turned off, and the ninth transistor M9 is turned on. The ninth transistor M9 transmits the data signal input from the data signal terminal Vdata to the first transistor M1 in the second data write module 1212. When the first transistor M1 is turned on, the data signal input from the data signal terminal Vdata is transmitted to the second terminal of the drive transistor D.

Figure 13:
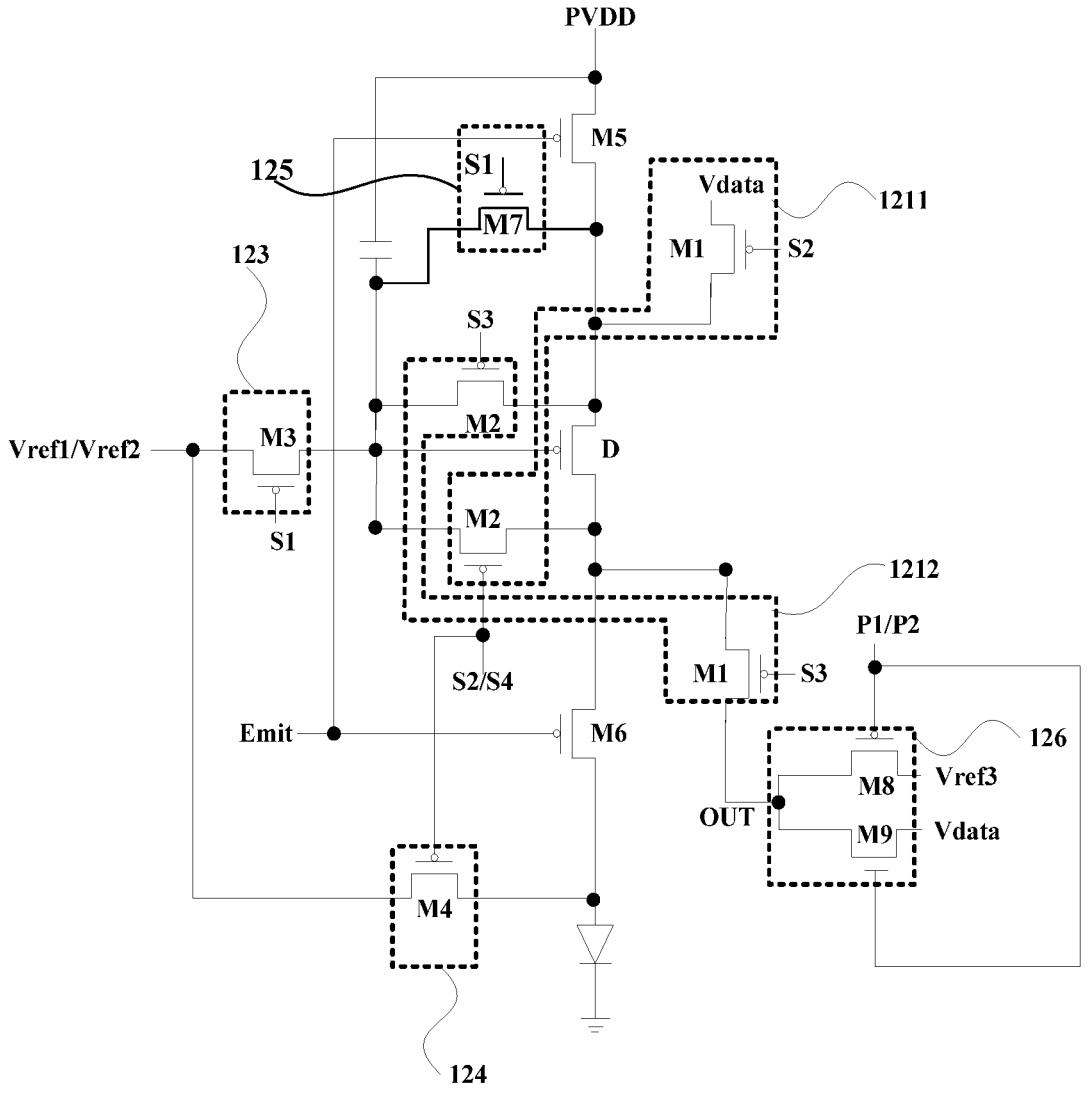
FIG. 13 is a structural diagram of another pixel driver circuit, according to an embodiment of the present disclosure.

In order to reduce the number of signal lines, the first control terminal may be set to be electrically connected to the second control terminal, and the eighth transistor M8 and the ninth transistor M9 have opposite conductivity types. For example, with reference to FIG. 13, the first control terminal P1 is electrically connected to the second control terminal P2, and the eighth transistor M8 and the ninth transistor M9 are controlled to be turned on or off by the same signal line in a time-sharing manner. In FIG. 13, an example in which the eighth transistor M8 is a P-type transistor and the ninth transistor M9 is an N-type transistor is used for description. If a control signal acquired by the first control terminal P1 and the second control terminal P2 is at a low level, the eighth transistor M8 is turned on, and the ninth transistor M9 is turned off. The eighth transistor M8 transmits the reset signal input from the third reset signal terminal Vref3 to the first transistor M1 in the second data write module 1212. When the third scan line signal is at a low level and the first transistor M1 is turned on, the reset signal input from the third reset signal terminal Vref3 is transmitted to the second terminal of the drive transistor D. If the control signal acquired by the first control terminal P1 and the second control terminal P2 is at a high level, the eighth transistor M8 is turned off, and the ninth transistor M9 is turned on. The ninth transistor M9 transmits the data signal input from the data signal terminal Vdata to the first transistor M1 in the second data write module 1212. When the third scan line signal is at a low level and the first transistor M1 is turned on, the data signal input from the data signal terminal Vdata is transmitted to the second terminal of the drive transistor D.

In the embodiments of the present disclosure, both the first control terminal P1 and the second control terminal P2 may be set to be electrically connected to the first scan signal terminal S1 of the first reset module 123. For example, with reference to FIG. 14, both the first control terminal P1 and the second control terminal P2 are electrically connected to the first scan signal terminal S1 of the first reset module 123, which can further reduce the number of signal lines in the display panel. While the first reset module 123 is reset, the third reset module 125 resets the first terminal or the second terminal of the drive transistor D (exemplarily, in FIG. 14, the third reset module 125 is set to reset the second terminal of the drive transistor D).

Figure 15:
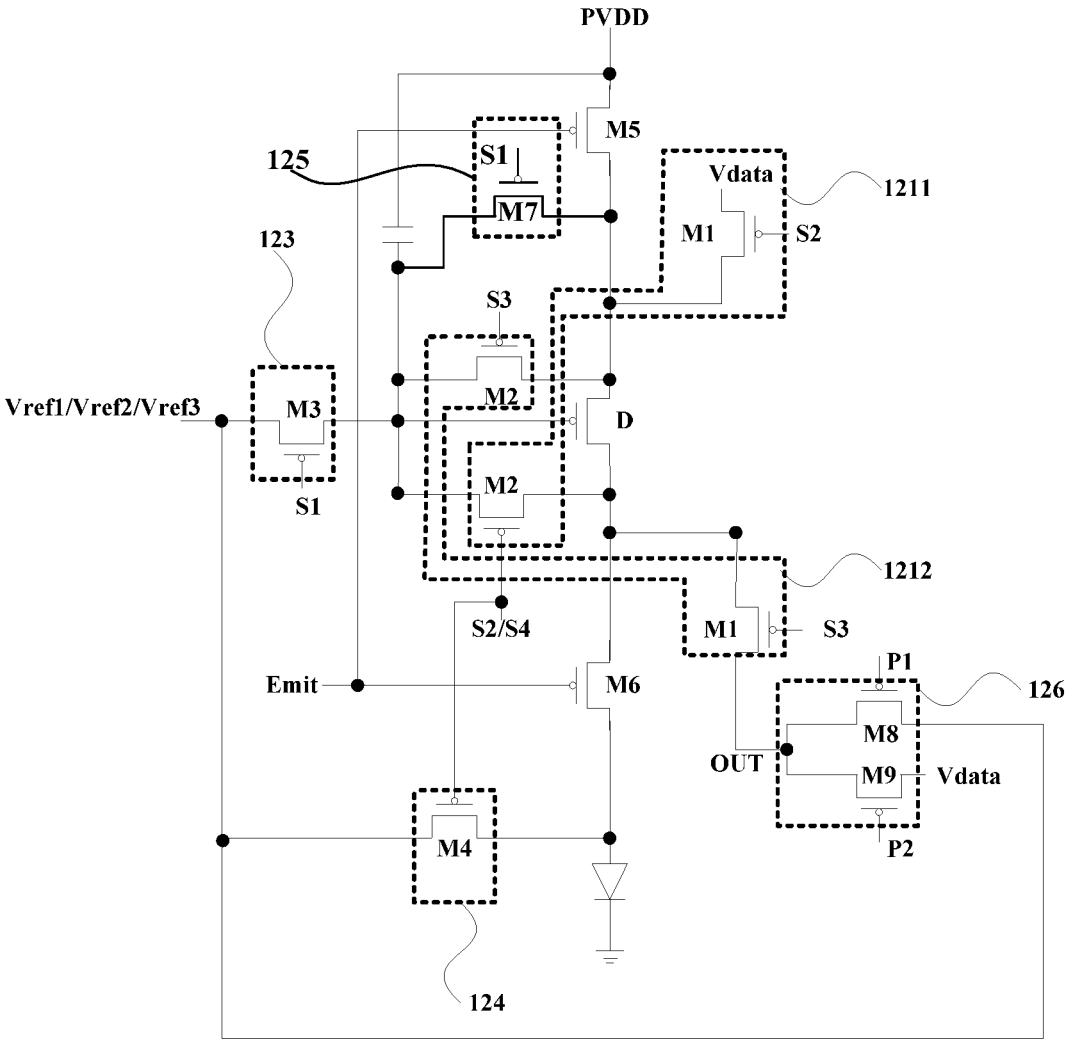
FIG. 15 is a structural diagram of another pixel driver circuit, according to an embodiment of the present disclosure.

In the embodiments of the present disclosure, the first reset signal terminal Vref1 may be set to be electrically connected to the third reset signal terminal Vref3, which, for example, is shown in FIG. 15.

Figure 16:
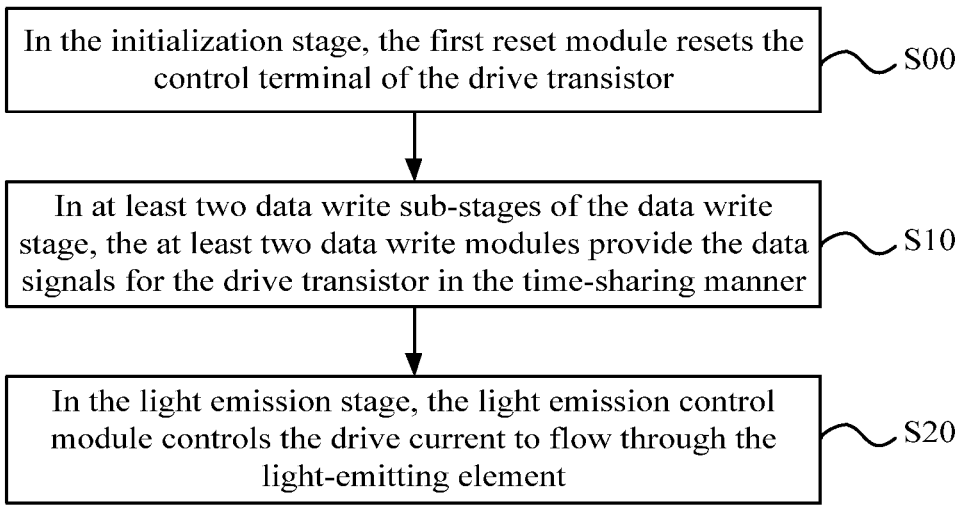
FIG. 16 is a flowchart of a driving method of a display panel, according to an embodiment of the present disclosure.
Figure 17:
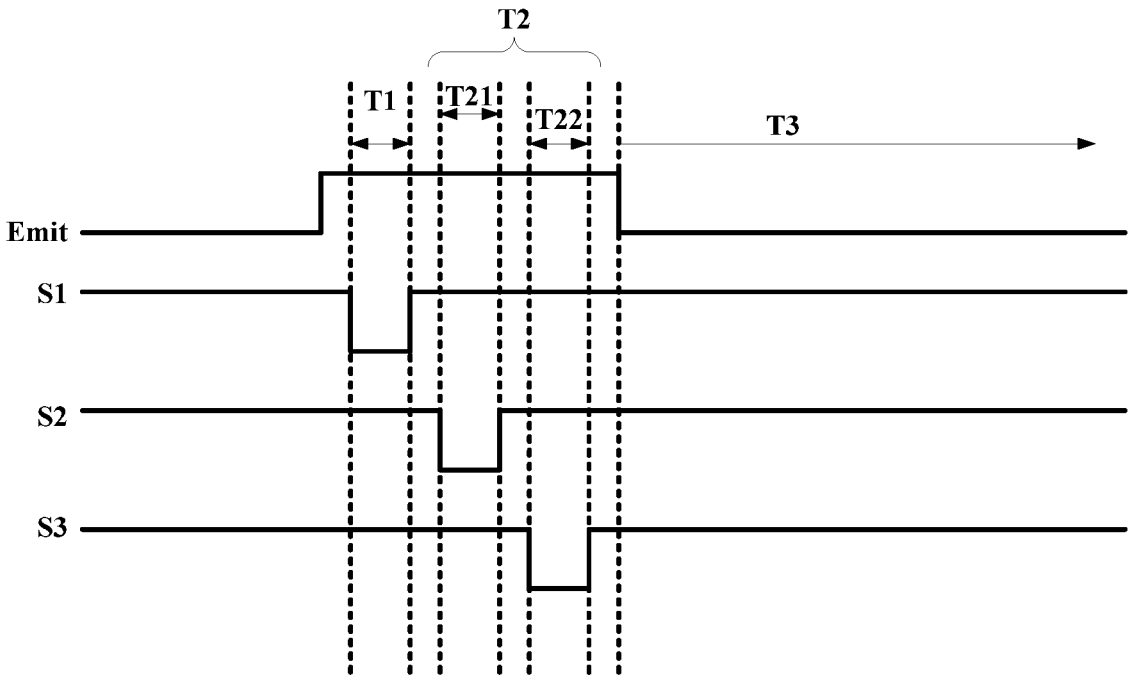
FIG. 17 is a drive timing diagram of a display panel, according to an embodiment of the present disclosure.

Based on the same concept, the embodiments of the present disclosure further provide a driving method of a display panel. FIG. 16 is a flowchart of a driving method of a display panel according to an embodiment of the present disclosure, with steps referenced as S00-S20. FIG. 17 is a drive timing diagram of a display panel according to an embodiment of the present disclosure. In the embodiments of the present disclosure, the drive period of the display panel includes a data write stage T2 and a light emission stage T3. The data write stage T2 includes at least two data write sub-stages. Exemplarily, in FIG. 17, the data write stage T2 includes at least two data write sub-stages which are a first data write sub-stage T21 and a second data write sub-stage T22, respectively.

In S10, in the at least two data write sub-stages T21, T22 of the data write stage, the at least two data write modules 121 provide the data signals for the drive transistor D in the time-sharing manner.

By using an example of the structure of the pixel driver circuit 12 shown in FIG. 3, in conjunction with FIG. 17, in the data write stage T2, the first data write module 1211 in the pixel driver circuit 12 provides the data signal for the drive transistor D in the first data write sub-stage T21, and the second data write module 1212 in the pixel driver circuit 12 provides the data signal for the drive transistor D in the second data write sub-stage T22.

In S20, in the light emission stage, the light emission control module 122 controls the drive current to flow through the light-emitting element.

In the embodiments of the present disclosure, at least two data write modules 121 are provided in the pixel driver circuit, and before the light emission stage, the at least two data write modules 121 provide the data signals for the drive transistor D in the at least two data write sub-stages of the data write stage in the time-sharing manner. The charging time is increased by performing multiple times of data writing, so that the data signal is sufficiently written into the drive transistor D before the light emission stage, and the data write modules 121 fully perform the threshold capture and compensation of the drive transistor D, thereby avoiding the flicker issue caused by high brightness in the initial stage of light emission due to undercharging.

On the basis of the above embodiments, the pixel driver circuit 12 may further include a first reset module 123, and the drive period of the display panel may further include an initialization stage T1 before the data write stage T2.

In S00, in the initialization stage, the first reset module 123 resets the control terminal of the drive transistor D.

For example, with reference to the pixel driver circuit 12 shown in FIGS. 3 to 6, before the data write stage T2, the first reset module 123 is turned on to reset the control terminal of the drive transistor D, so as to prevent the voltage on the control terminal of the drive transistor D from affecting the display of the next frame of image when the previous frame of image is displayed. In FIG. 17, the first scan signal is represented by S1 and is configured to control the first reset module 123 to be turned on or off.

If the pixel driver circuit 12 in the above embodiments may include a second reset module 124, the second reset module 124 is electrically connected to the light-emitting element and is configured to reset the light-emitting element. In the driving method provided by the embodiments of the present disclosure, in at least part of a time period in other stages except for the light emission stage T3, the second reset module 124 resets the light-emitting element. For example, with reference to FIG. 18, the fourth scan signal S4 controls the second reset module 124 to be turned on or off. The fourth scan signal S4 controls the second reset module 124 to be turned on in the initialization stage T1 and the data write stage T2 to reset the light-emitting element.

Figure 19:
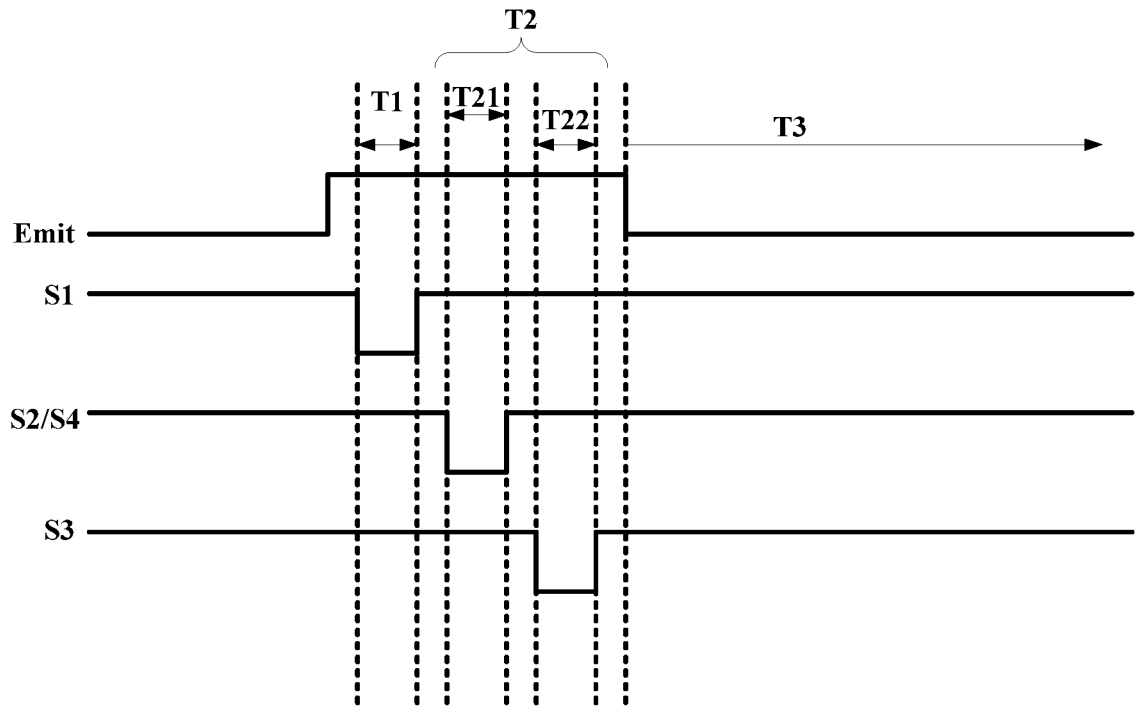
FIG. 19 is another drive timing diagram of a display panel, according to an embodiment of the present disclosure.

FIG. 19 is another drive timing diagram according to an embodiment of the present disclosure. With reference to FIG. 19, if the fourth scan signal terminal S4 is electrically connected to the second scan signal terminal S2, the fourth scan signal S4 (or the second scan signal S2) controls the second reset module 124 to be turned on to reset the light-emitting element in the first data write sub-stage T21.

Figure 20:
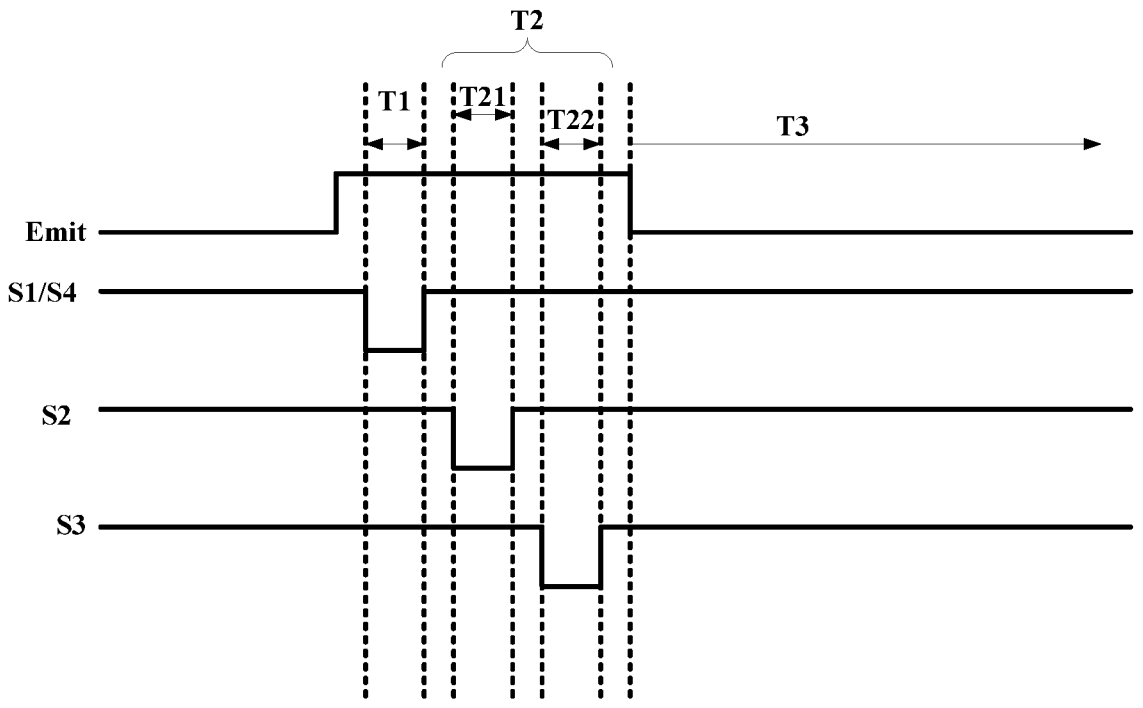
FIG. 20 is another drive timing diagram of a display panel, according to an embodiment of the present disclosure.

FIG. 20 is another drive timing diagram according to an embodiment of the present disclosure. With reference to FIG. 20, if the fourth scan signal terminal S4 is electrically connected to the first scan signal terminal S1, the fourth scan signal S4 (or the first scan signal S1) controls the second reset module 124 to be turned on to reset the light-emitting element in the initialization stage T1.

Figure 21:
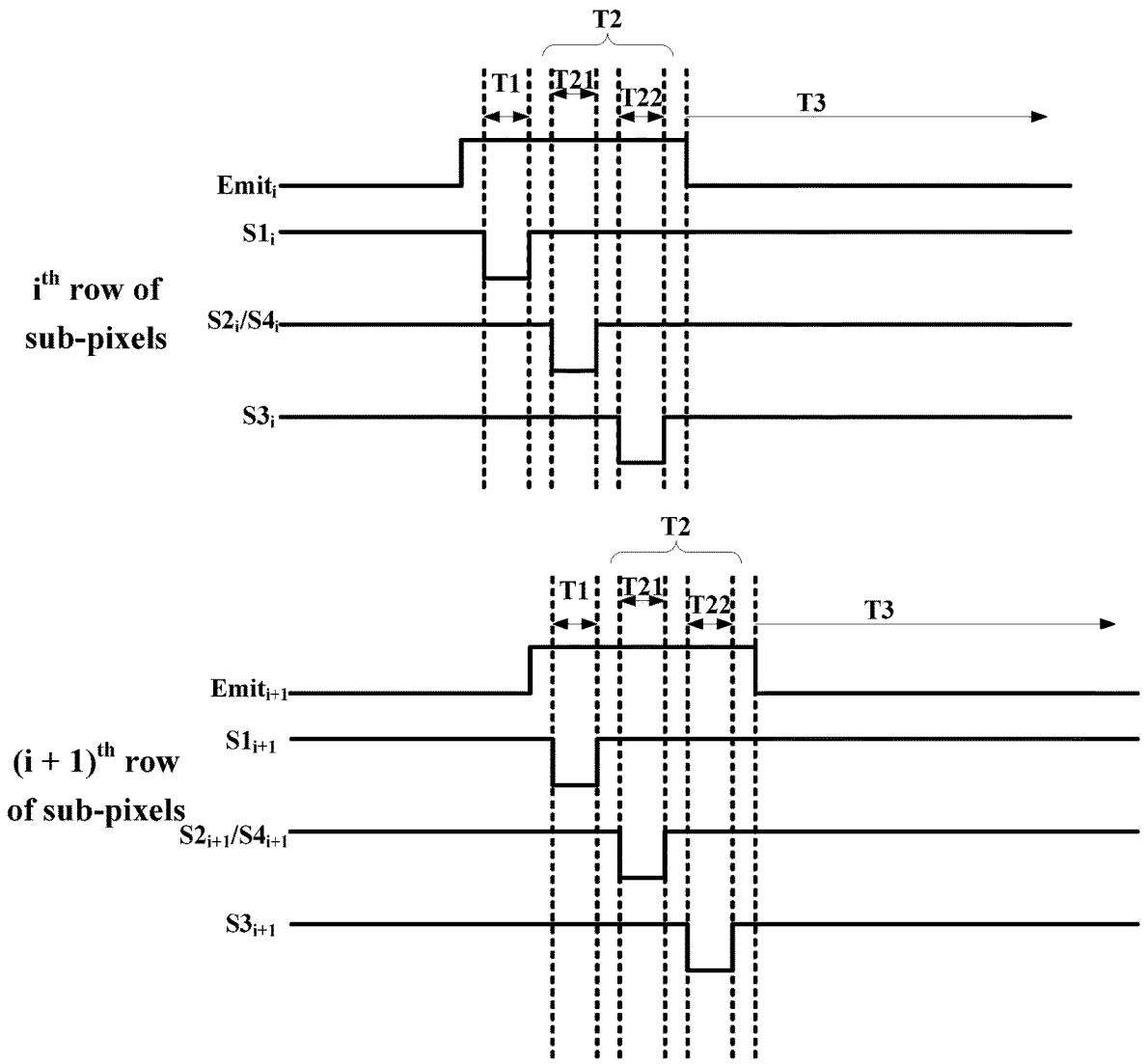
FIG. 21 is another drive timing diagram of a display panel, according to an embodiment of the present disclosure.

If the pixel driver circuit 12 includes two data write modules 121 which are the first data write module 1211 and the second data write module 1212, respectively. Both the control terminal of the first transistor M1 in the first data write module 1211 and the control terminal of the second transistor M2 in the first data write module 1211 are electrically connected to the second scan signal terminal S2. Both the control terminal of the first transistor M1 in the second data write module 1212 and the control terminal of the second transistor M2 in the second data write module 1212 are electrically connected to the third scan signal terminal S3. The third scan signal terminal S3 of the pixel driver circuit 12 in an $i^{th}$ row of sub-pixels 10 is electrically connected to the second scan signal terminal S2 of pixel driver circuits 12 in an $(i+1)^{th}$ row of sub-pixels 10. By using an example of the pixel driver circuit 12 in FIG. 6, for the drive timing of the pixel driver circuit, reference is made to FIG. 21. FIG. 21 illustrates a drive timing of adjacent two rows of sub-pixels 10 according to an embodiment of the present disclosure. The adjacent two rows of sub-pixels represent the $i^{th}$ row of sub-pixels and the $(i+1)^{th}$ row of sub-pixels 10, respectively. The data write stage T2 includes the first data write sub-stage T21 and the second data write sub-stage T22. Before the second data write sub-stage T22 is performed in the $i^{th}$ row of sub-pixels, the first data write sub-stage T21 is performed in the $(i+1)^{th}$ row of sub-pixels, where i is a positive integer. Each subscript of S1, S2, S3, S4, and Emit represents a row sequence number of sub-pixels 10.

If the pixel driver circuit 12 includes a third reset module 125, and the third reset module 125 is electrically connected to the first terminal of the drive transistor D and is configured to reset the first terminal of the drive transistor D before the data write stage. If the control terminal of the seventh transistor M7 in the third reset module 125 of the pixel driver circuit 12 and the control terminal of the third transistor M3 of the first reset module 123 are connected to the same signal line, as shown in FIG. 11, both the seventh transistor M7 and the third transistor M3 are controlled by the first scan signal S1, and the control terminal and the first terminal of the drive transistor D are reset simultaneously in the initialization stage.

The working process of the pixel driver circuit 12 of this embodiment is described in detail hereinafter in connection with FIG. 4 and FIG. 18.

In S00, in the initialization stage, the first scan signal S1 is at an effective level and controls the third transistor M3 to be turned on, and the third transistor M3 transmits a reset signal input from the first reset signal terminal Vref1 to the control terminal of the drive transistor D to reset the control terminal of the drive transistor D, thereby preventing the voltage on the control terminal of the drive transistor D from affecting the display of the next frame of image when the previous frame of image is displayed.

In S10, the data write stage T2 includes the first data write sub-stage T21 and the second data write sub-stage T22. In the first data write sub-stage T21, the second scan signal S2 is at an effective level and controls the first transistor M1 and the second transistor M2 of the first data write module 1211 to be turned on, and the data signal on the data signal terminal Vdata is written into the control terminal of the drive transistor D sequentially through the first transistor M1 of the first data write module 1211, the drive transistor D, and the second transistor M2 of the first data write module 1211, that is, first-time data writing is performed through the source of the drive transistor D. In the second data write sub-stage T22, the third scan signal S3 is at an effective level and controls the first transistor M1 and the second transistor M2 of the second data write module 1212 to be turned on, and the data signal on the data signal terminal Vdata is written into the drive transistor D sequentially through the first transistor M1 of the second data write module 1212, the drive transistor D, and the second transistor M2 of the second data write module 1212, that is, second-time data writing is performed through the source of the drive transistor D.

Figure 18:
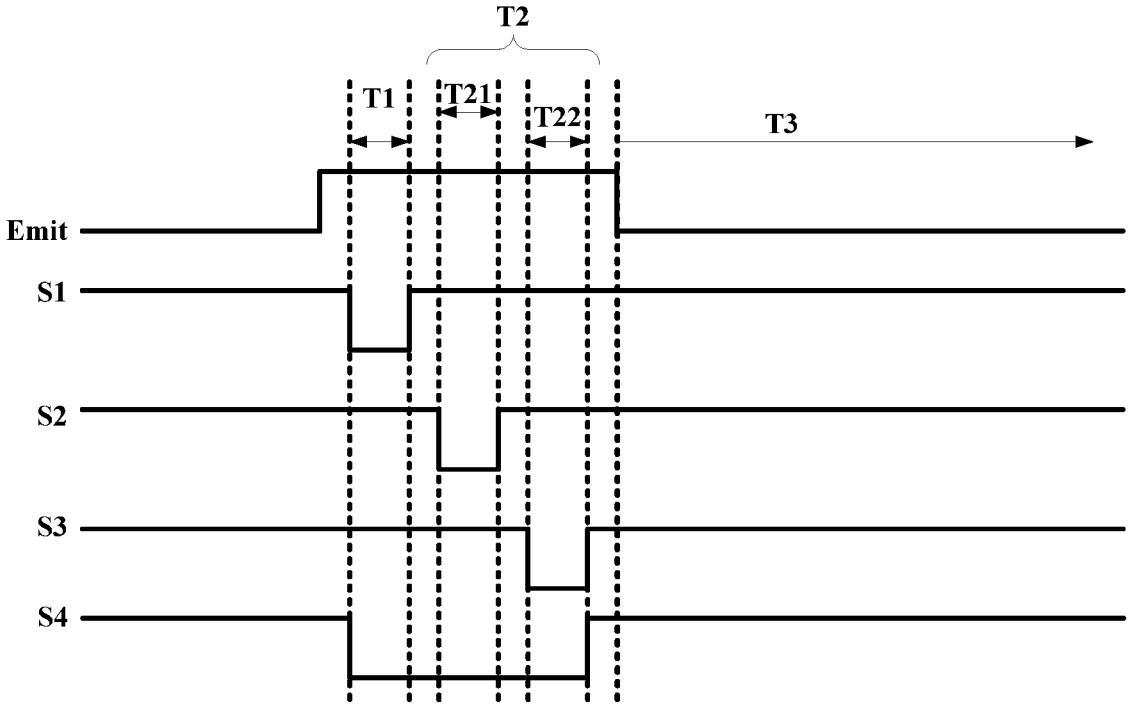
FIG. 18 is another drive timing diagram of a display panel, according to an embodiment of the present disclosure.

With reference to FIG. 18, the fourth scan signal S4 is at an effective level in both the initialization stage T1 and the data write stage T2 and controls the fourth transistor M4 to be turned on to reset the light-emitting element 11.

In S20, in the light emission stage T3, the light emission control signal Emit is at an effective level, the first scan signal S1, the second scan signal S2, the third scan signal S3, and the fourth scan signal S4 are each at an ineffective level, the fifth transistor M5 and the sixth transistor M6 in the light emission control module 122 are turned on. The first transistor M1 and the second transistor M2 in the first data write module 1211, the first transistor M1 and the second transistor M2 in the second data write module 1212, the third transistor M3 of the first reset module 123, and the fourth transistor M4 of the second reset module 124 are all turned off, and the fifth transistor M5 transmits the power voltage signal PVDD to the first terminal of the drive transistor D so that the drive transistor D is turned on and drives the light-emitting element 11 to emit light.

The drive timing of the pixel driver circuit 12 shown in FIG. 5 may be similar to the drive timing in FIG. 18, and the difference between the drive timing of the pixel driver circuit 12 in FIG. 5 and the drive timing of the pixel driver circuit 12 shown in FIG. 4 is that the data is written through the drain of the drive transistor D (the second terminal of the drive transistor D) in the two data write sub-stages of FIG. 5.

Figure 7:
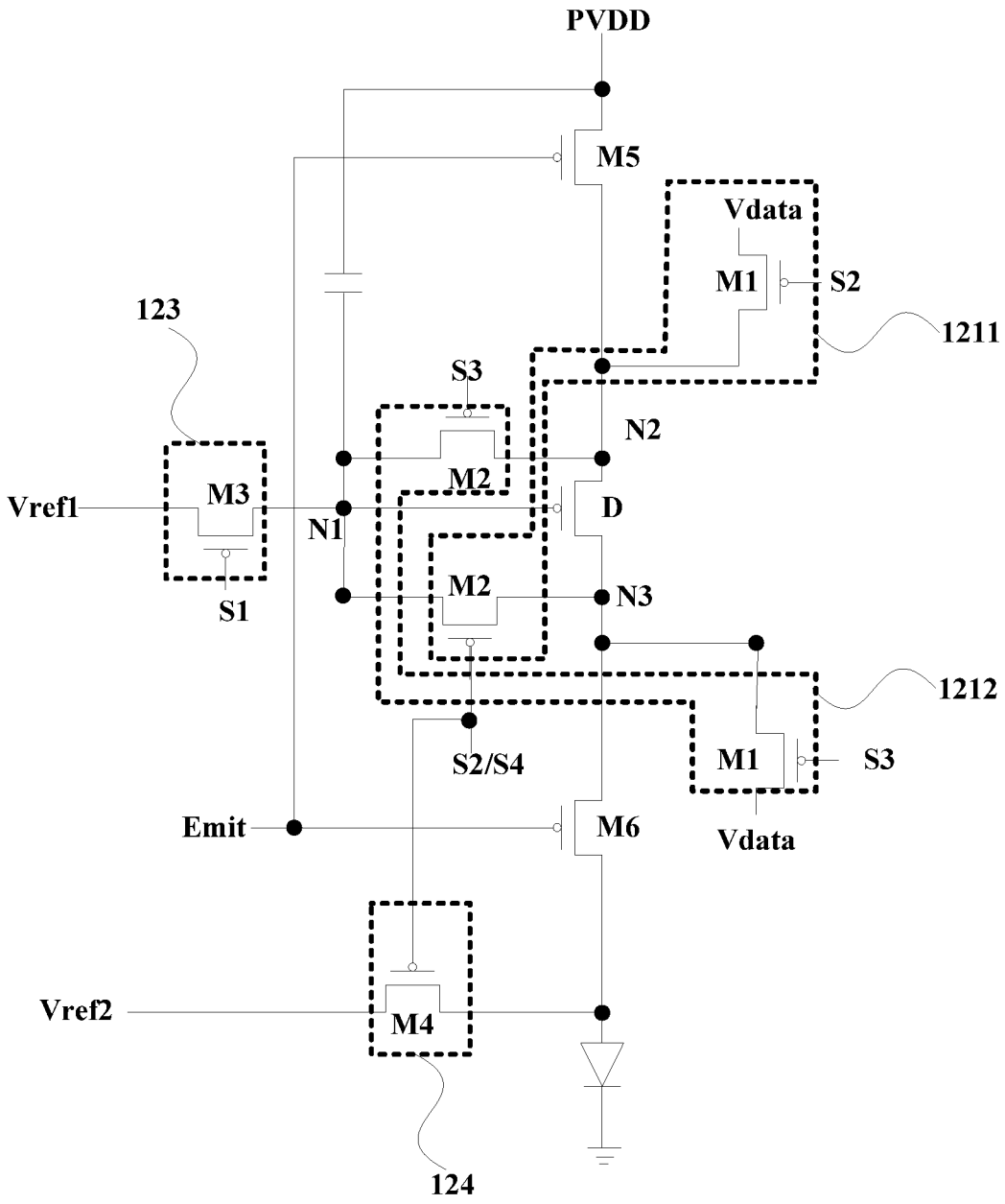
FIG. 7 is a structural diagram of another pixel driver circuit, according to an embodiment of the present disclosure.

The working process of the pixel driver circuit 12 of this embodiment is described in detail hereinafter in connection with FIG. 7 and FIG. 19.

In S00, in the initialization stage, the first scan signal S1 is at an effective level and controls the third transistor M3 to be turned on, and the third transistor M3 transmits the reset signal input from the first reset signal terminal Vref1 to the control terminal of the drive transistor D to reset the control terminal of the drive transistor D, thereby preventing the voltage on the control terminal of the drive transistor D from affecting the display of the next frame of image when the previous frame of image is displayed.

In S10, the data write stage T2 includes the first data write sub-stage T21 and the second data write sub-stage T22. In the first data write sub-stage T21, the second scan signal S2 is at an effective level and controls the first transistor M1 and the second transistor M2 of the first data write module 1211 to be turned on, and the data signal on the data signal terminal Vdata is written into the control terminal of the drive transistor D sequentially through the first transistor M1 of the first data write module 1211, the drive transistor D, and the second transistor M2 of the first data write module 1211, that is, the first-time data writing is performed through the source of the drive transistor D.

Since the fourth scan signal terminal of the fourth transistor M4 of the second reset module 124 is electrically connected to the second scan signal terminal of the first data write module 1211, when the second scan signal S2 is at an effective level, the fourth transistor M4 is turned on and transmits the second reset signal Vref2 to the light-emitting element to reset the electrode of the light-emitting element.

In the second data write sub-stage T22, the third scan signal S3 is at an effective level and controls the first transistor M1 and the second transistor M2 of the second data write module 1212 to be turned on, and the data signal on the data signal terminal Vdata is written into the control terminal of the drive transistor D sequentially through the first transistor M1 of the second data write module 1212, the drive transistor D, and the second transistor M2 of the second data write module 1212, that is, the second-time data writing is performed through the drain of the drive transistor D.

In the process of twice data writing in the embodiments of the present disclosure, the direction of the current flowing through the drive transistor D is different so that the hysteresis effect caused by the offset generated on the Id-Vg curve of the drive transistor D can be suppressed to a certain extent.

In S20, in the light emission stage T3, the light emission control signal Emit is at an effective level, the first scan signal S1, the second scan signal S2, the third scan signal S3, and the fourth scan signal S4 are each at an ineffective level, the fifth transistor M5 and the sixth transistor M6 in the light emission control module 122 are turned on. The first transistor M1 and the second transistor M2 in the first data write module 1211, the first transistor M1 and the second transistor M2 in the second data write module 1212, the third transistor M3 of the first reset module 123, and the fourth transistor M4 of the second reset module 124 are all turned off, and the fifth transistor M5 transmits the power voltage signal PVDD to the first terminal of the drive transistor D so that the drive transistor D is turned on and drives the light-emitting element 11 to emit light.

Figure 14:
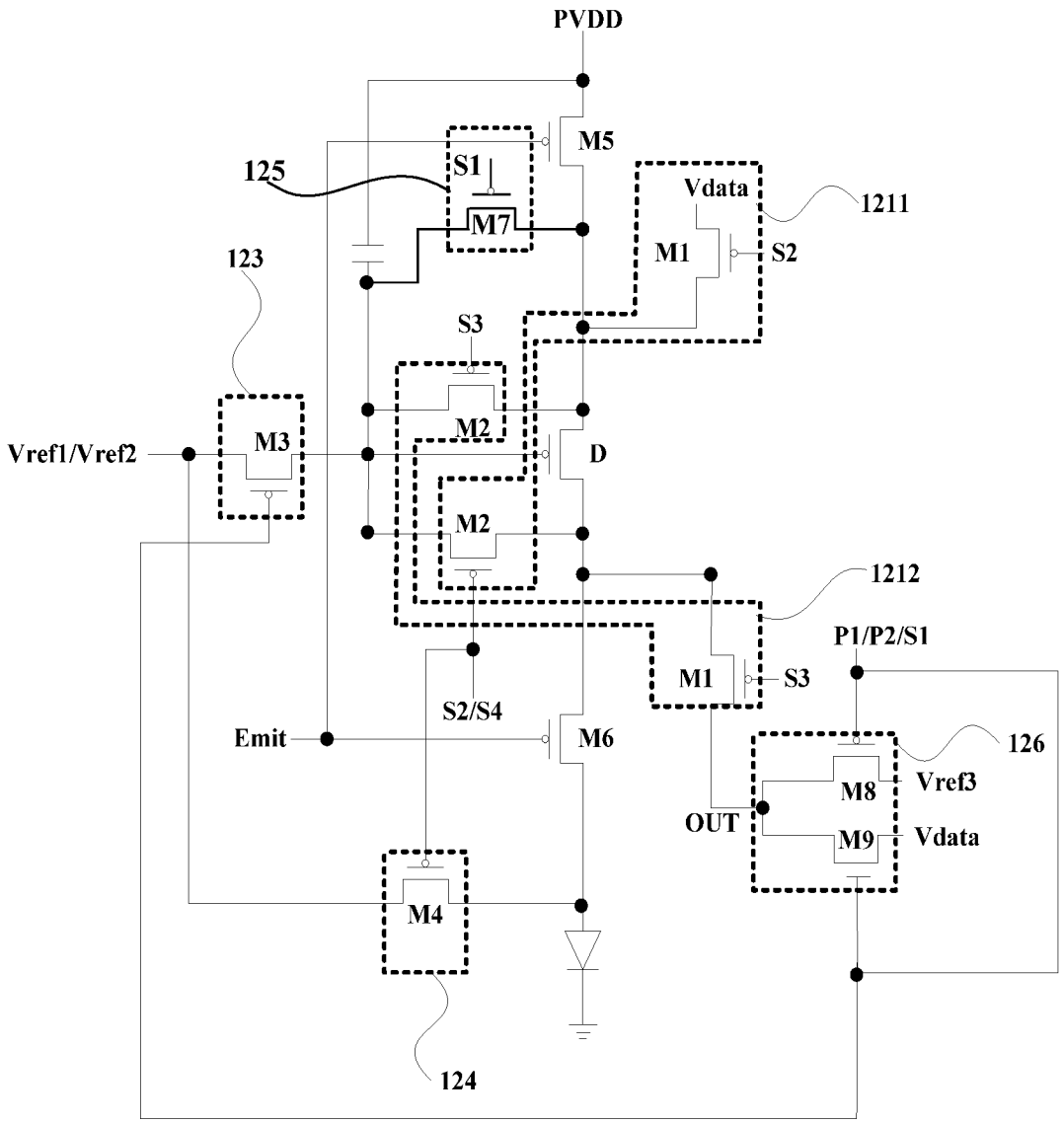
FIG. 14 is a structural diagram of another pixel driver circuit, according to an embodiment of the present disclosure.
Figure 22:
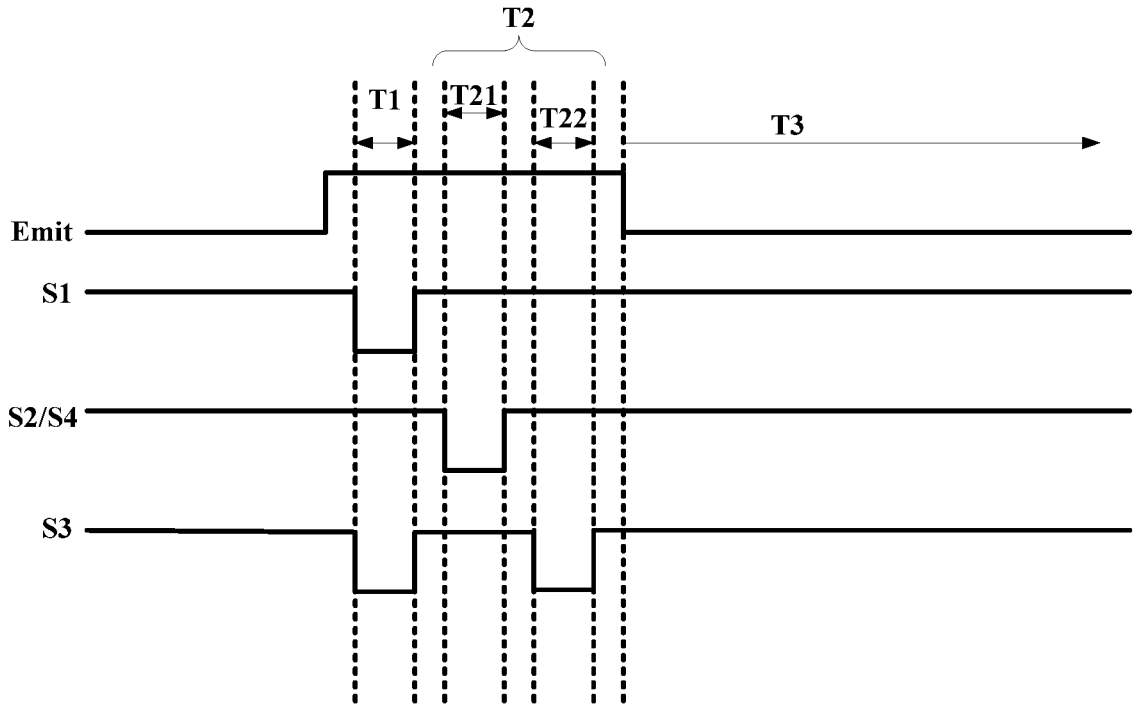
FIG. 22 is another drive timing diagram of a display panel, according to an embodiment of the present disclosure.

The working process of the pixel driver circuit 12 of this embodiment is described in detail hereinafter in connection with FIG. 14 and FIG. 22.

In S00, in the initialization stage, the first scan signal S1 is at an effective level and controls the third transistor M3 to be turned on, and the third transistor M3 transmits the reset signal input from the first reset signal terminal Vref1 to the control terminal of the drive transistor D to reset the control terminal of the drive transistor D, thereby preventing the voltage on the control terminal of the drive transistor D from affecting the display of the next frame of image when the previous frame of image is displayed.

The control terminal of the eighth transistor M8 and the control terminal of the ninth transistor M9 in the gating module 126 are both connected to the first scan signal terminal S1 so that the first scan signal S1 simultaneously controls the eighth transistor M8 and the ninth transistor M9. The eighth transistor M8 and the ninth transistor M9 have opposite conductivity types. In FIG. 14, the eighth transistor M8 is a P-type transistor and the ninth transistor M9 is an N-type transistor, therefore, when the first scan signal S1 is at a low level in the initialization stage, the eighth transistor M8 is turned on and the ninth transistor M9 is turned off. The eighth transistor M8 transmits the reset signal of the third reset signal terminal to the first transistor M1 of the second data write module 1212. The third scan signal S3 is also at an effective level (a low level) in the initialization stage, and the first transistor M1 is turned on to reset the second terminal of the drive transistor D.

In S10, the data write stage T2 includes the first data write sub-stage T21 and the second data write sub-stage T22. In the first data write sub-stage T21, the second scan signal S2 is at an effective level and controls the first transistor M1 and the second transistor M2 of the first data write module 1211 to be turned on, and the data signal on the data signal terminal Vdata is written into the control terminal of the drive transistor D sequentially through the first transistor M1 of the first data write module 1211, the drive transistor D, and the second transistor M2 of the first data write module 1211, that is, the first-time data writing is performed through the source of the drive transistor D.

Since the fourth scan signal terminal of the fourth transistor M4 of the second reset module 124 is electrically connected to the second scan signal terminal S2 of the first data write module 1211, when the second scan signal S2 is at an effective level, the fourth transistor M4 is turned on and transmits the second reset signal Vref2 to the light-emitting element to reset the electrode of the light-emitting element.

In the second data write sub-stage T22, the third scan signal S3 is at an effective level and controls the first transistor M1 and the second transistor M2 of the second data write module 1212 to be turned on, and the data signal on the data signal terminal Vdata is written into the control terminal of the drive transistor D sequentially through the first transistor M1 of the second data write module 1212, the drive transistor D, and the second transistor M2 of the second data write module 1212, that is, the second-time data writing is performed through the drain of the drive transistor D.

In S20, in the light emission stage T3, the light emission control signal Emit is at an effective level, the first scan signal S1, the second scan signal S2, the third scan signal S3, and the fourth scan signal S4 are each at an ineffective level, the fifth transistor M5 and the sixth transistor M6 in the light emission control module 122 are turned on. The first transistor M1 and the second transistor M2 in the first data write module 1211, the first transistor M1 and the second transistor M2 in the second data write module 1212, the third transistor M3 of the first reset module 123, the fourth transistor M4 of the second reset module 124, the eighth transistor M8, and the ninth transistor M9 are turned off, and the fifth transistor M5 transmits the power voltage signal PVDD to the first terminal of the drive transistor D so that the drive transistor D is turned on and drives the light-emitting element 11 to emit light.

The higher the drive frequency of the display panel is, the shorter the scanning signal pulse is, and thus the more severe the undercharging is, the more obvious the flicker phenomenon perceived by the human eyes is. According to the embodiments of the present disclosure, the driving mode may be adjusted according to the drive frequency of the display panel.

The driving method of the display panel provided by the embodiments of the present disclosure further includes steps described below.

First, a drive frequency of the display panel is acquired.

In the data write stage, at least a partial number of the at least two data write modules 121 of the pixel driver circuit 12 are driven to provide the data signals for the drive transistor D in the time-sharing manner according to the drive frequency of the display panel.

The drive frequency of the display panel has a positive correlation with the number of data write modules 121 providing the data signals for the drive transistor D in the time-sharing manner. The higher the drive frequency is, the more the number of data writing times is, thereby solving the undercharging issue caused by high-frequency driving.

On the basis of the above embodiments, if the pixel driver circuit 12 includes N data write modules 121, N gate driver circuits need to be provided in the display panel. In pixel driver circuits 12 for each row of sub-pixels 10, data write modules 121 for providing the data signals for the drive transistor D in a $j^{th}$ data write sub-stage are connected to a same gate driver circuit. That is, in pixel driver circuits 12 for each row of sub-pixels 10, data write modules 121 for providing the data signals for the drive transistor D in the $j^{th}$ data write sub-stage are electrically connected in one-to-one correspondence to stage shift registers of the same gate driver circuit. In each pixel driver circuit, data write modules 121 for providing the data signals for the drive transistor D in different data write sub-stages are electrically connected to different gate driver circuits. N is a positive integer greater than 1, and j is a positive integer greater than or equal to 1 and less than or equal to N.

Figure 23:
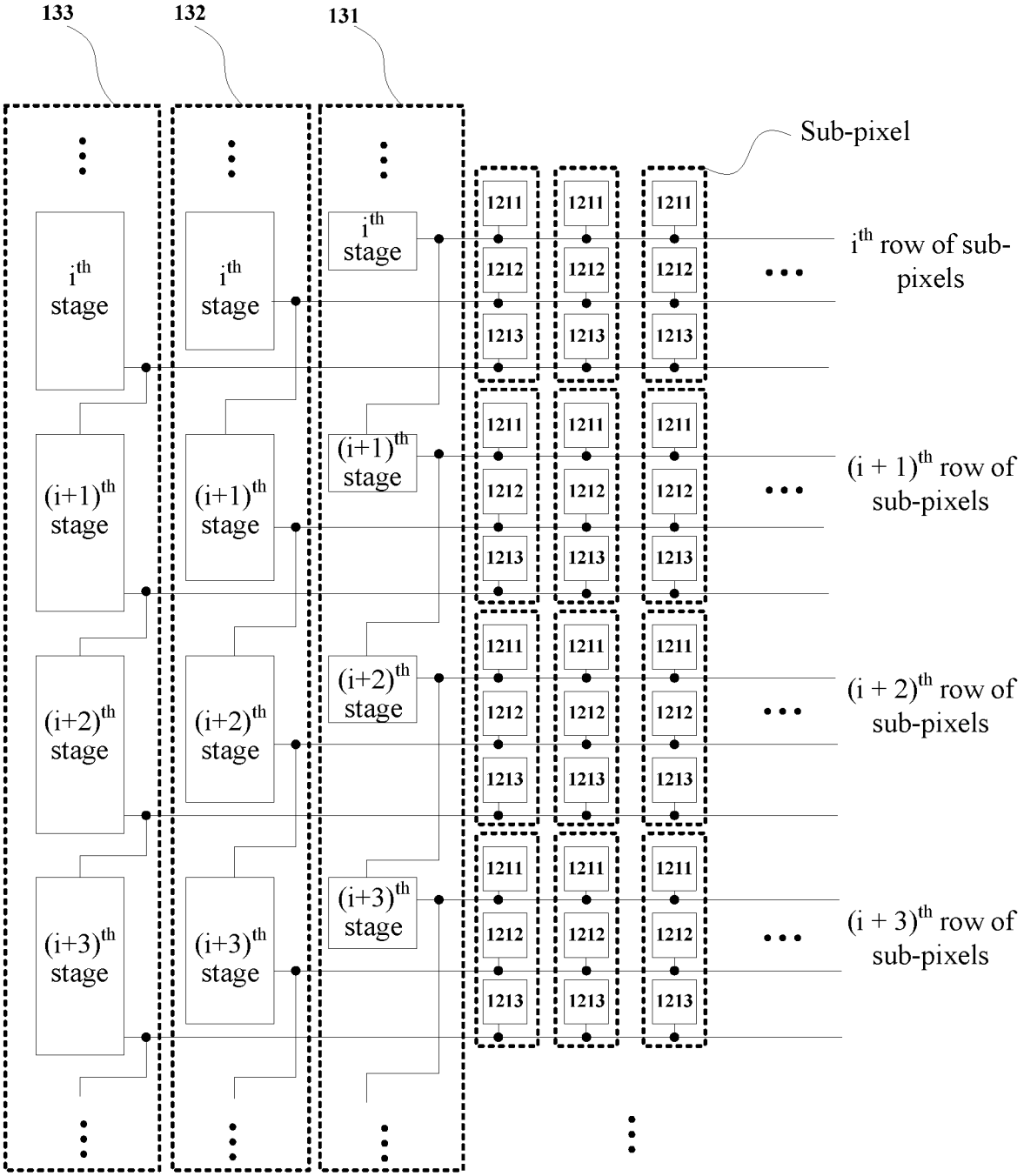
FIG. 23 is a structural diagram of another display panel, according to an embodiment of the present disclosure.

The following is described by using an example in which N is equal to 3. As shown in FIG. 23, each pixel driver circuit 12 includes three data write modules 121 which are denoted as a first data write module 1211, a second data write module 1212, and a third data write module 1213, respectively. The display panel is provided with three gate driver circuits which are denoted as a first gate driver circuit 131, a second gate driver circuit 132, and a third gate driver circuit 133, respectively. First data write modules 1211 in the pixel driver circuits 12 for each row of sub-pixels 10 are all connected to the first gate driver circuit 131, second data write modules 1212 in the pixel driver circuits 12 for each row of sub-pixels 10 are all connected to the second gate driver circuit 132, and third data write modules 1213 in the pixel driver circuits 12 for each row of sub-pixels 10 are all connected to the third gate driver circuit 133. Each gate driver circuit 131, 132, 133 includes cascaded shift registers.

The first data write module 1211 in each pixel driver circuit 12 of an $i^{th}$ row of sub-pixels 10 is connected to an $i^{th}$ stage shift register of the first gate driver circuit 131. The second data write module 1212 in each pixel driver circuit 12 of the $i^{th}$ row of sub-pixels 10 is connected to an $i^{th}$ stage shift register of the second gate driver circuit 132. The third data write module 1213 in each pixel driver circuit 12 of the $i^{th}$ row of sub-pixels 10 are connected to an $i^{th}$ stage shift register of the third gate driver circuit 133. i is a row sequence number of sub-pixels 10.

If the drive frequency of the display panel is f1, the first data write module 1211 in each pixel driver circuit 12 of each row of sub-pixels 10 is controlled by the first gate driver circuit 131 to perform the data writing only once. If the drive frequency of the display panel is f2, the first data write module 1211 in each pixel driver circuit 12 of each row of sub-pixels 10 is controlled by the first gate driver circuit 131 to perform the first-time data writing, and the second data write module 1212 in each pixel driver circuit 12 of each row of sub-pixels 10 is controlled through the second gate driver circuit 132 to perform the second-time data writing. If the drive frequency of the display panel is f3, the first data write module 1211 in each pixel driver circuit 12 of each row of sub-pixels 10 is controlled by the first gate driver circuit 131 to perform the first-time data writing, the second data write module 1212 in each pixel driver circuit 12 of each row of sub-pixels 10 is controlled by the second gate driver circuit 132 to perform the second-time data writing, and the third data write module 1213 in each pixel driver circuit 12 of each row of sub-pixels 10 is controlled by the third gate driver circuit 133 to perform the third data writing. f1 is less than f2, and f2 is less than f3.

It is to be noted that the embodiments of the present disclosure do not limit the type of transistors in each module of the pixel driver circuit. For example, all transistors may be N-type transistors or P-type transistors, or some of the transistors may be N-type transistors and some of the transistors may be P-type transistors according to actual requirements. The transistors in each module of the pixel driver circuit 12, according to actual requirements, may be transistors in which the active layer adopts an oxide semiconductor or transistors adopting an oxide semiconductor.

It is to be noted that the preceding are only alternative embodiments of the present disclosure and the technical principles used therein. It is to be understood by those skilled in the art that the present disclosure is not limited to the embodiments described herein. Those skilled in the art can make various apparent modifications, adaptations, combinations and substitutions without departing from the scope of the present disclosure. Therefore, while the present disclosure has been described in detail via the preceding embodiments, the present disclosure is not limited to the preceding embodiments and may include equivalent embodiments without departing from the concept of the present disclosure. The scope of the present disclosure is determined by the scope of the appended claims.

What is claimed is:

1. A display panel, comprising:

a plurality of sub-pixels arranged in an array; each of the plurality of sub-pixels comprising a light-emitting element; and a pixel driver circuit, the pixel driver circuit having a drive transistor, at least two data write modules, and a light emission control module, the at least two data write modules being configured to provide data signals for the drive transistor in a time-sharing manner, the light emission control module being connected in series respectively with the drive transistor and the light-emitting element, and the light emission control module being configured to control whether a drive current flows through the light-emitting element;

wherein each of the at least two data write modules comprises a first transistor and a second transistor, the first transistor configured to write a data signal input from a data signal terminal to the drive transistor, and the second transistor configured to detect and self-compensate for a deviation of a threshold voltage of the drive transistor;

wherein a second terminal of the second transistor is electrically connected to a control terminal of the drive transistor;

wherein a first terminal of the first transistor is electrically connected to the data signal terminal, a second terminal of the first transistor is electrically connected to a first terminal of the drive transistor, and a first terminal of the second transistor is electrically connected to a second terminal of the drive transistor; or a first terminal of the first transistor is electrically connected to the data signal terminal, a second terminal of the first transistor is electrically connected to a second terminal of the drive transistor, and a first terminal of the second transistor is electrically connected to a first terminal of the drive transistor;

wherein the light emission control module comprises a third transistor and a fourth transistor; and wherein a first terminal of the third transistor is electrically connected to a first power signal terminal, and a second terminal of the third transistor is electrically connected to the first terminal of the drive transistor; a first terminal of the fourth transistor is electrically connected to the second terminal of the drive transistor, and a second terminal of the fourth transistor is electrically connected to the light-emitting element.

2. The display panel of claim 1, wherein the at least two data write modules comprise a first data write module and a second data write module, a control terminal of the first transistor in the first data write module is electrically connected to a control terminal of the second transistor in the first data write module; and a control terminal of the first transistor in the second data write module is electrically connected to a control terminal of the second transistor in the second data write module.

3. The display panel of claim 2; wherein both the control terminal of the first transistor in the first data write module and the control terminal of the second transistor in the first data write module are electrically connected to a second scan signal terminal; the control terminal of the first transistor in the second data write module and the control terminal of the second transistor in the second data write module are electrically connected to a first scan signal terminal; and the first scan signal terminal is electrically connected to the second scan signal terminal of pixel driver circuits in a next row of sub-pixels.

4. The display panel of claim 1, wherein the pixel driver circuit further comprises a first reset module, and the first reset module is electrically connected to the control terminal of the drive transistor and is configured to reset the control terminal of the drive transistor;

wherein the first reset module comprises a fifth transistor, and the fifth transistor is connected in series between the control terminal of the drive transistor and a first reset signal terminal.

5. The display panel of claim 1, wherein the pixel driver circuit further comprises a first reset module, and the first reset module is electrically connected to the light-emitting element and is configured to reset the light-emitting element; wherein the first reset module comprises a fifth transistor, and the fifth transistor is connected in series between a first reset signal terminal and the light-emitting element.

6. The display panel of claim 5, wherein a control terminal of the fifth transistor is electrically connected to a first scan signal terminal; and the first scan signal terminal is electrically connected to one of the following control terminals in one of the at least two data write modules: a control terminal of first transistor or a control terminal of the second transistor.

7. The display panel of claim 5, wherein the pixel driver circuit farther comprises a second reset module which is configured to reset the control terminal of the drive transistor and comprises a sixth transistor; and Wherein the sixth transistor is connected in series between the control terminal of the drive transistor and a second reset signal terminal; a control terminal of the fifth transistor is electrically connected to a second scan signal terminal; a control terminal of the sixth transistor is electrically connected to a first scan signal terminal; and the second scan signal terminal is electrically connected to the first scan signal terminal.

8. The display panel of claim 5, wherein the pixel driver circuit further comprises a second reset module which is configured to reset the control terminal of the drive transistor and comprises a sixth transistor; and wherein the sixth transistor is connected in series between the control terminal of the drive transistor and a second reset signal terminal; and the second reset signal terminal is electrically connected to the first reset signal terminal.

9. The display panel of claim 1, wherein the pixel driver circuit further comprises a first reset module, and the first reset module is electrically connected to the first terminal of the drive transistor and is configured to reset the first terminal of the drive transistor;

wherein the first reset module comprises a fifth transistor, and a first terminal of the fifth transistor is electrically connected to the control terminal of the drive transistor, and a second terminal of the fifth transistor is electrically connected to the first terminal of the drive transistor.

10. The display panel of claim 9, wherein the pixel driver circuit further comprises a second reset module, the second reset module is electrically connected to the control terminal of the drive transistor, and the second reset module is configured to reset the control terminal of the drive transistor and comprises a sixth transistor; and wherein the sixth transistor is connected in series between the control terminal of the drive transistor and a first reset signal terminal; and a control terminal of the fifth transistor is electrically connected to a control terminal of the sixth transistor.

11. The display panel of claim 1, wherein the pixel driver circuit further comprises a gating module; the gating module comprises a first reset signal terminal, a data signal terminal, a first control terminal, a second control terminal, and an output terminal; and the output terminal of the gating module is electrically connected to one of the at least two data write modules;

wherein the gating module is configured to transmit, under the control of a first control signal input from the first control terminal and a second control signal input from the second control terminal, one of a reset signal input from the first reset signal terminal or a data signal input from the data signal terminal to the one of the at least two data write modules which is electrically connected to the gating module;

wherein the gating module comprises a fifth transistor and a sixth transistor;

wherein a first terminal of the fifth transistor is electrically connected to the first reset signal terminal, a second terminal of the fifth transistor is electrically connected to the output terminal of the gating module; and a control terminal of the fifth transistor is electrically connected to the first control terminal; and wherein a first terminal of the sixth transistor is electrically connected to the data signal terminal, a second terminal of the sixth transistor is electrically connected to the output terminal of the gating module; and a control terminal of the sixth transistor is electrically connected to the second control terminal.

12. The display panel of claim 11, wherein the first control terminal is electrically connected to the second control terminal; and the fifth transistor and the sixth transistor have opposite conductivity types.

13. The display panel of claim 12, wherein the pixel driver circuit further comprises a first reset module which is configured to reset the control terminal of the drive transistor and comprises a seventh transistor; and wherein the seventh transistor is connected in series between the control terminal of the drive transistor and a second reset signal terminal; a control terminal of the seventh transistor is electrically connected to a first scan signal terminal; and both the first control terminal and the second control terminal are electrically connected to the first scan signal terminal.

14. A driving method of a display panel, applied to the display panel of claim 1, wherein a drive period of the display panel comprises a data write stage and a light emission stage, and the data write stage comprises at least two data write sub-stages;

wherein the driving method comprises:

in the at least two data write sub-stages of the data write stage, providing, by the at least two data write modules, the data signals for the drive transistor in the time-sharing manner; and in the light emission stage, controlling, by the light emission control module, the drive current to flow through the light-emitting element.

15. The driving method of claim 14, wherein the pixel driver circuit further comprises a first reset module, and the drive period of the display panel further comprises an initialization stage; and wherein the driving method further comprises:

in the initialization stage before the data write stage, resetting, by the first reset module, the control terminal of the drive transistor;

wherein the pixel driver circuit further comprises a second reset module, and the second reset module is electrically connected to the light-emitting element; and Wherein the method further comprises:

in at least part of a time period in other stages except for the light emission stage, resetting, by the second reset module, the light-emitting element.

16. The driving method of claim 14, wherein the at least two data write modules comprise a first data write module and a second data write module, both a control terminal of the first transistor in the first data write module and a control terminal of the second transistor in the first data write module are electrically connected to a second scan signal terminal, and both a control terminal of the first transistor in the second data write module and a control terminal of the second transistor in the second data write module are electrically connected to a first scan signal terminal; and the first scan signal terminal in pixel driver circuits of an $i^{th}$ row of sub-pixels is electrically connected to the second scan signal terminal in pixel driver circuits of an $(i+1)^{th}$ row of sub-pixels; and wherein the data write stage comprises a first data write sub-stage and a second data write sub-stage; when the second data write sub-stage is performed in the row of sub-pixels, the first data write sub-stage is performed in the $(i+1)^{th}$ row of sub-pixels; wherein i is a positive integer.

17. The driving method of claim 14, further comprising: acquiring a drive frequency of the display panel; and driving, in the data write stage, at least a partial number of the at least two data write modules of the pixel driver circuit to provide the data signals to the drive transistor in the time-sharing manner according to the drive frequency of the display panel;

wherein the drive frequency of the display panel has a positive correlation with a number of data write modules providing the data signals for the drive transistor in the time-sharing manner.

18. The driving method of claim 17, wherein the display panel comprises N gate driver circuits; and the pixel driver circuit comprises N data write modules;

wherein in pixel driver circuits for each row of sub-pixels, data write modules for providing the data signals for the drive transistor in a $j^{th}$ data write sub-stage are connected to a same gate driver circuit; and in each pixel driver circuit, data write modules for providing the data signals to the drive transistor in different data write sub-stages are connected to different gate driver circuits;

wherein N is a positive integer greater than 1, and j is a positive integer greater than or equal to 1 and less than or equal to N.

* * * * *